US007605537B2

(12) United States Patent
Kim et al.

(10) Patent No.: US 7,605,537 B2
(45) Date of Patent: Oct. 20, 2009

(54) PLASMA DISPLAY PANEL HAVING BUS ELECTRODES EXTENDING ACROSS AREAS OF NON-DISCHARGE REGIONS

(75) Inventors: Woo-Tae Kim, Yongin-si (KR); Kyoung-Doo Kang, Seoul (KR); Hun-Suk Yoo, Cheonan-si (KR); Seok-Gyun Woo, Ahsan-si (KR); Jae-Ik Kwon, Ahsan-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 418 days.

(21) Appl. No.: 10/871,427

(22) Filed: Jun. 18, 2004

(65) Prior Publication Data

US 2004/0256989 A1 Dec. 23, 2004

(30) Foreign Application Priority Data

| | | |
|---|---|---|
| Jun. 19, 2003 | (KR) | 10-2003-0039955 |
| Jul. 22, 2003 | (KR) | 10-2003-0050278 |
| Jul. 24, 2003 | (KR) | 10-2003-0051009 |
| Jul. 30, 2003 | (KR) | 10-2003-0052598 |
| Aug. 1, 2003 | (KR) | 10-2003-0053461 |

(51) Int. Cl.
*H01J 17/49* (2006.01)
*H01J 17/00* (2006.01)

(52) U.S. Cl. ..... 313/582; 313/567; 313/584; 313/585; 313/586

(58) Field of Classification Search ..... 313/582, 313/584, 585
See application file for complete search history.

(56) References Cited

U.S. PATENT DOCUMENTS 5,640,068 A 6/1997 Amemiya (Continued)

FOREIGN PATENT DOCUMENTS

CN 1154528 A 7/1997

(Continued)

OTHER PUBLICATIONS

European Patent Office Search Report, dated Feb. 3, 2005, for application No. 04090020.1, in the name of Samsung SDI Co., Ltd.

(Continued)

*Primary Examiner*—Nimeshkumar D. Patel
*Assistant Examiner*—Natalie K Walford
(74) *Attorney, Agent, or Firm*—Christie, Parker & Hale, LLP

(57) ABSTRACT

A plasma display panel includes first and second substrates opposing one another. Address electrodes are formed on the second substrate. Barrier ribs are mounted between the first and second substrates defining discharge cells and non-discharge regions. Phosphor layers are formed within each of the discharge cells. Discharge sustain electrodes are formed on the first substrate. The non-discharge regions are formed in areas encompassed by discharge cell abscissas and ordinates passing through centers of the discharge cells. Further, the discharge cells are formed such that ends thereof increasingly decrease in width as a distance from centers of the discharge cells is increased. The discharge sustain electrodes include bus electrodes that extend perpendicular to the address electrodes and outside areas of the discharge cells but across areas of the non-discharge regions, and protrusion electrodes formed extending from each of the bus electrodes.

29 Claims, 19 Drawing Sheets

U.S. PATENT DOCUMENTS

| | | | | |
|---|---|---|---|---|
| 5,952,782 | A | 9/1999 | Nanto et al. | |
| 6,031,329 | A * | 2/2000 | Nagano | 313/582 |
| 6,200,182 | B1 | 3/2001 | Nanto et al. | |
| 6,249,264 | B1 | 6/2001 | Sano et al. | |
| 6,288,488 | B1 | 9/2001 | Amemiya | |
| 6,373,195 | B1 | 4/2002 | Whang et al. | |
| 6,376,986 | B1 | 4/2002 | Takagi et al. | |
| 6,424,095 | B1 | 7/2002 | Hirao et al. | |
| 6,479,932 | B1 | 11/2002 | Nunomura | |
| 6,495,957 | B2 | 12/2002 | Kurogi et al. | |
| 6,498,593 | B1 | 12/2002 | Fujimoto et al. | |
| 6,504,519 | B1 | 1/2003 | Ryu et al. | |
| 6,522,072 | B1 | 2/2003 | Yura et al. | |
| 6,534,914 | B2 | 3/2003 | Amemiya et al. | |
| 6,577,061 | B2 | 6/2003 | Sano et al. | |
| 6,603,263 | B1 | 8/2003 | Hashimoto et al. | |
| 6,608,441 | B2 | 8/2003 | Kunii et al. | |
| 6,630,788 | B1 | 10/2003 | Park | |
| 6,639,363 | B2 | 10/2003 | Amatsuchi et al. | |
| 6,646,377 | B2 | 11/2003 | Hashimoto | |
| 6,657,386 | B2 | 12/2003 | Koshio et al. | |
| 6,670,754 | B1 | 12/2003 | Murai et al. | |
| 6,674,238 | B2 | 1/2004 | Otani et al. | |
| 6,700,323 | B2 * | 3/2004 | Amemiya | 313/582 |
| 6,703,772 | B2 | 3/2004 | Hasegawa et al. | |
| 6,707,259 | B2 | 3/2004 | Nagao et al. | |
| 6,727,869 | B1 | 4/2004 | Kosaka | |
| 6,774,558 | B2 * | 8/2004 | Otani et al. | 313/587 |
| 6,819,046 | B2 | 11/2004 | Hirano | |
| 6,838,828 | B2 | 1/2005 | Joo et al. | |
| 6,853,136 | B2 | 2/2005 | Kim et al. | |
| 6,870,314 | B2 | 3/2005 | Kifune et al. | |
| 6,946,785 | B2 | 9/2005 | Ito et al. | |
| 7,012,370 | B2 * | 3/2006 | Kanazawa et al. | 313/582 |
| 7,088,314 | B2 | 8/2006 | Harada et al. | |
| 7,136,033 | B2 | 11/2006 | Kim et al. | |
| 7,166,960 | B2 | 1/2007 | Kim et al. | |
| 7,208,875 | B2 | 4/2007 | Kwon et al. | |
| 7,327,083 | B2 * | 2/2008 | Woo et al. | 313/587 |
| 7,365,712 | B2 | 4/2008 | Yi | |
| 2002/0000779 | A1 | 1/2002 | Anders | |
| 2002/0021090 | A1 | 2/2002 | Sano et al. | |
| 2002/0047519 | A1 | 4/2002 | Kunii et al. | |
| 2002/0063510 | A1 | 5/2002 | Yura et al. | |
| 2003/0080682 | A1 | 5/2003 | Nagano | |
| 2003/0193487 | A1 | 10/2003 | Yatsuda et al. | |
| 2004/0051457 | A1 | 3/2004 | Kimura et al. | |
| 2004/0085264 | A1 | 5/2004 | Takada et al. | |
| 2004/0113555 | A1 | 6/2004 | Han et al. | |
| 2004/0234902 | A1 | 11/2004 | Toyoda et al. | |
| 2004/0263078 | A1 | 12/2004 | Woo et al. | |
| 2005/0001551 | A1 | 1/2005 | Kim et al. | |
| 2005/0017637 | A1 | 1/2005 | Kang et al. | |
| 2005/0029939 | A1 | 2/2005 | Woo et al. | |
| 2005/0088094 | A1 | 4/2005 | Kim et al. | |
| 2005/0134176 | A1 * | 6/2005 | Kwon et al. | 313/582 |
| 2005/0212430 | A1 | 9/2005 | Ahn et al. | |
| 2007/0114933 | A1 | 5/2007 | Kim et al. | |

FOREIGN PATENT DOCUMENTS

| | | | |
|---|---|---|---|
| CN | 1264914 | | 8/2000 |
| CN | 1267877 | | 9/2000 |
| CN | 1327253 | | 12/2001 |
| CN | 1337665 | | 2/2002 |
| CN | 1344005 | | 4/2002 |
| CN | 1397976 | | 2/2003 |
| CN | 1397976 | A | 2/2003 |
| EP | 0 920 048 | A2 | 6/1999 |
| EP | 1 263 014 | A1 | 12/2002 |
| JP | 4-298936 | | 10/1992 |
| JP | 5-94772 | | 4/1993 |
| JP | 6-44907 | | 2/1994 |
| JP | 6-342631 | | 12/1994 |
| JP | 7-65728 | | 3/1995 |
| JP | 10-149771 | | 6/1998 |
| JP | 10-269951 | | 10/1998 |
| JP | 10-283934 | | 10/1998 |
| JP | 10-308179 | | 11/1998 |
| JP | 10-334811 | | 12/1998 |
| JP | 11-31460 | | 2/1999 |
| JP | 11-96921 | | 4/1999 |
| JP | 11-213893 | | 8/1999 |
| JP | 11-317170 | | 11/1999 |
| JP | 11-345570 | | 12/1999 |
| JP | 2000-11899 | | 1/2000 |
| JP | 2000-21313 | | 1/2000 |
| JP | 2000-42661 | | 2/2000 |
| JP | 2000-82407 | | 3/2000 |
| JP | 2000-113828 | | 4/2000 |
| JP | 2000-187200 | | 7/2000 |
| JP | 2000-195431 | | 7/2000 |
| JP | 2000-228150 | | 8/2000 |
| JP | 2000223034 | A * | 8/2000 |
| JP | 2000-323045 | | 11/2000 |
| JP | 2000-357459 | | 12/2000 |
| JP | 2001-126628 | | 5/2001 |
| JP | 2001-160361 | | 6/2001 |
| JP | 2001-210241 | | 8/2001 |
| JP | 2001-283734 | | 10/2001 |
| JP | 2001-345054 | | 12/2001 |
| JP | 2002-25451 | | 1/2002 |
| JP | 2002-83545 | | 3/2002 |
| JP | 2002-93327 | | 3/2002 |
| JP | 2002-190256 | | 7/2002 |
| JP | 2002-197981 | | 7/2002 |
| JP | 2002-203487 | | 7/2002 |
| JP | 2002-216642 | | 8/2002 |
| JP | 2002-231146 | | 8/2002 |
| JP | 2002-245943 | | 8/2002 |
| JP | 2002245943 | A * | 8/2002 |
| JP | 2002-260537 | | 9/2002 |
| JP | 2002-324488 | | 11/2002 |
| JP | 2002-373593 | | 12/2002 |
| JP | 2003-16944 | | 1/2003 |
| JP | 2003-31130 | | 1/2003 |
| JP | 2003-051258 | | 2/2003 |
| JP | 2003-68212 | | 3/2003 |
| JP | 2003-68215 | | 3/2003 |
| JP | 2003-086106 | | 3/2003 |
| JP | 2003-132805 | | 5/2003 |
| JP | 2003-157773 | | 5/2003 |
| JP | 2003-303550 | | 10/2003 |
| JP | 2003-303551 | | 10/2003 |
| JP | 2004-164885 | | 6/2004 |
| KR | 1998-030878 | | 8/1998 |
| KR | 1999-0062632 | | 7/1999 |
| KR | 1999-0065408 | | 8/1999 |
| KR | 1999065408 | A * | 8/1999 |
| KR | 2001-0016651 | | 3/2001 |
| KR | 2001-0062222 | | 7/2001 |
| KR | 2001-0093724 | | 10/2001 |
| KR | 2002-0036012 | | 5/2002 |
| KR | 2002-0055807 | | 7/2002 |
| KR | 2002-0069025 | | 8/2002 |
| KR | 2003-0033658 | | 5/2003 |
| KR | 10-2003-0042538 | | 6/2003 |
| KR | 2003-0044667 | | 6/2003 |
| KR | 2003-0061079 | | 7/2003 |
| KR | 10-2004-0032508 | | 4/2004 |
| WO | WO99/50877 | | 10/1999 |

WO WO00/46832 8/2000

OTHER PUBLICATIONS

Korean Patent Abstracts for publication No. 1020030061079, with a date of publication of Jul. 18, 2003, in the name of Y. Ahn et al.
Korean Patent Abstracts for publication No. 1020010093724, with a date of publication of Oct. 29, 2001, in the name of K. Morikawa et al.
Korean Patent Abstracts for publication No. 1020040032508, with a date of publication of Apr. 17, 2004, in the name of B. Lee.
Patent Abstracts of Japan for publication No. 2001-210241, with a date of publication of Aug. 3, 2001, in the name of T. Kosaka.
Patent Abstracts of Japan for publication No. 2002-083545, with a date of publication of Mar. 22, 2002, in the name of Y. Kunii et al.
Patent Abstracts of Japan for publication No. 2000-195431, with a publication date of Jul. 14, 2000, in the name of T. Komaki et al.
European Patent Office Patent Abstracts of Japan for publication No. 2003-3030551, with a publication date of Oct. 24, 2003, in the name of S. Kan.
European Patent Office Patent Abstracts of Japan for publication No. 2003303550, with a publication date of Oct. 24, 2003, in the name of S. Kan.
European Patent Office Patent Abstracts of Japan for publication No. 2002245943, with a publication date of Aug. 30, 2002, in the name of T. Sakurai.
U.S. Appl. No. 10/746,540, filed Dec. 23, 2003, Kwon et al.
U.S. Appl. No. 10/746,541, filed Dec. 23, 2003, Kwon et al.
U.S. Appl. No. 10/751,341, filed Jan. 2, 2004, Kwon et al.
Patent Abstract of Japan 10-149771, Published Jun. 2, 1998, in the name of Yatsuda, et al.
Patent Abstract of Japan 2001-345054, Published Dec. 14, 2001, in the name of Sano, et al.
Patent Abstract of Japan 2002-231146, Published Aug. 16, 2002, in the name of Yura, et al.
Patent Abstracts of Japan, Publication No. 06-342631, Published Dec. 13, 1994 in the name of Noborio.
Patent Abstracts of Japan, Publication No. 10-269951, Published Oct. 9, 1998 in the name of Fumihiro.
Patent Abstracts of Japan, Publication No. 11-213893, Published Aug. 6, 1999 in the name of Toshie et al.
Patent Abstracts of Japan, Publication No. 2000-187200, Published Jul. 4, 2000 in the name of Pascale et al.
Patent Abstracts of Japan, Publication No. 2002-025451, Published Jan. 25, 2002 in the name of Toshihiko et al.
Patent Abstracts of Japan, Publication No. 2002-197981, Published Jul. 12, 2002 in the name of Toshihiro et al.
Patent Abstracts of Japan, Publication No. 2003-016944, Published Jan. 17, 2003 in the name of Kimio.
Patent Abstracts of Japan, Publication No. 2003-031130, Published Jan. 31, 2003in the name of Eishiro et al.
Patent Abstracts of Japan, Publication No. 2003-068212, Published Mar. 7, 2003 in the name of Naoki et al.
Patent Abstracts of Japan, Publication No. 2003-068215, Published Mar. 7, 2003 in the name of Shuichi et al.
Patent Abstracts of Japan, Publication No. 2003-132805. Published May 9, 2003 in the name of Tomohiro et al.
Patent Abstract of Japan, Publication No. 2004-164885, Published Jun. 10, 2004 in the name of Takashi et al.
Patent Abstracts of Japan, Publication No. 05-094772; Publication Date: Apr. 16, 1993; in the name of Noborio.
Patent Abstracts of Japan, Publication No. 10-334811; Publication Date: Dec. 18,1998; in the name of Aoki et al.
Patent Abstracts of Japan, Publication No. 11-096921; Publication Date: Apr. 9, 1999; in the name of Tomioka et al.
Patent Abstracts of Japan, Publication No. 11-317170; Publication Date: Nov. 16, 1999; in the name of Kado et al.
Patent Abstracts of Japan, Publication No. 2000-042661; Publication Date: Feb. 15, 2000; in the name of Arima et al.
Patent Abstracts of Japan, Publication No. 2000-357459; Publication Date: Dec. 26, 2000; in the name of Jae et al.
Patent Abstracts of Japan, Publication No. 2002-260537; Publication Date: Sep. 13, 2002; in the name of Ito et al.
Korean Patent Abstracts, Publication No. 1020010016651 A; Publication Date: Mar. 5, 2001; in the name of Park.
Korean Patent Abstracts, Publication No. 1020020055807 A; Publication Date: Jul. 10, 2002; in the name of Kim.
Korean Patent Abstracts, Publication No. 1020030044667 A; Publication Date: Jun. 9, 2003; in the name of Lee.
Patent Abstracts of Japan for Publication No. 10-283934; Date of publication of application: Oct. 23, 1998, in the name of Tsutomu Tokunaga et al.
Patent Abstracts of Japan for Publication No. 11-345570; Date of publication of application: Dec. 14, 1999, in the name of Takaaki Murata et al.
Patent Abstracts of Japan for Publication No. 2000-011899; Date of publication of application: Jan. 14, 2000, in the name of Kimio Amamiya.
Patent Abstracts of Japan for Publication No. 2000-021313; Date of publication of application: Jan. 21, 2000, in the name of Kenji Yoshida et al.
Patent Abstracts of Japan for Publication No. 2000-323045; Date of publication of application: Nov. 24, 2000, in the name of Kazuki Takagi et al.
Patent Abstracts of Japan for Publication No. 2001-283734; Date of publication of application: Oct. 12, 2001, in the name of Sukeyuki Nishimura et al.
Patent Abstracts of Japan for Publication No. 2002-373593; Date of publication of application: Dec. 26, 2002, in the name of Hiroshi Kanda.
Patent Abstracts of Japan for Publication No. 10-308179, Date of publication of application Nov. 17, 1998, in the name of K. Aoto et al.
Patent Abstracts of Japan for Publication No. 2001-160361; Date of publication of application Jun. 12, 2001, in the name of S. Yura et al.
Patent Abstracts of Japan for Publication No. 2002-324488; Date of publication of application Nov. 8, 2002, in the name of N. Hirano et al.
Patent Abstracts of Japan for Publication No. 04-298936; Date of publication of application Oct. 22, 1992, in the name of T. Okajima.
Korean Utility Model Abstracts for Publication No. 2019980030878; Date of Publication of application Aug. 17, 1998, in the name of B. Choi.
Korean Patent Abstracts for Publication No. 1020020036012; Date of publication of application May 16, 2002, in the name of U. Kim.
Korean Patent Abstracts for Publication No. 1020010062222, publication date of Jul. 7, 2001, in the name of K. Amemiya et al.
Patent Abstracts of Japan for Publication No. 2002-245943, publication date of Aug. 30, 2002, in the name of K. Morikawa et al.
Korean Patent Abstracts for Publication No. 1019990065408A, publication date of Aug. 5, 1999, in the name of S. Lee.
Patent Abstracts of Japan, Publication No. 2002-190256; Date of Publication May 7, 2002, Takada, et al.
Patent Abstracts of Japan, Publication No. 06-044907, dated Feb. 18, 1994, in the name of Tetsuji Okajima.
Patent Abstracts of Japan, Publication No. 2002-203487, dated Jul. 19, 2002, in the name of S. Shiromizu.
Patent Abstracts of Japan, Publication No. 2003-157773, dated May 30, 2003, in the name of Tomohiro Kimura et al.
Korean Patent Abstracts for Publication No. 1020030033658; dated May 1, 2003, in the name of Gwang Yeol Choi.
U.S. Office action dated Aug. 22, 2008, for corresponding U.S. Appl. No. 10/929,626, indicating relevance of references listed in this IDS.
Patent Abstracts of Japan, Publication No. 07-065728, dated Mar. 10, 1995, in the name of Tatsutoshi Kanae et al.
Patent Abstracts of Japan, Publication No. 11-031460, dated Feb. 2, 1999, in the name of Takaaki Murata et al.
Patent Abstracts of Japan, Publication No. 2000-082407, dated Mar. 21, 2000, in the name of Toshihiro Komaki et al.
Patent Abstracts of Japan, Publication No. 2000-113828, dated Apr. 21, 2000, in the name of Masaki Kuroki et al.
Patent Abstracts of Japan, Publication No. 2002-093327, dated Mar. 29, 2002, in the name of Masaki Aoki et al.
English translation for KR 10-2003-0042538 A, dated Jun. 2, 2003, listed above.

U.S. Office action dated Dec. 4, 2008; for related U.S. Appl. No. 10/999,231, indicating relevance of listed U.S. references 6,674,238 and 6,819,056 in this IDS.
Patent Abstracts of Japan, Publication No. 2000-228150, dated Aug. 15, 2000, in the name of Naoto Hirano et al.
Patent Abstracts of Japan, Publication No. 2001-126628, dated May 11, 2001, in the name of Takahiro Torisalci et al.
Patent Abstracts of Japan, Publication No. 2002-216642, dated Aug. 2, 2002, in the name of Kiyoshi Chiyoda et al.
Patent Abstracts of Japan, Publication No. 2003-051258, dated Feb. 21, 2003, in the name of Keisuke Sumita et al.
Patent Abstracts of Japan, Publication No. 2003-086106, dated Mar. 20, 2003, in the name of Hiroshi Mori et al.
U.S. Office action dated Jan. 28, 2009, for related U.S. Appl. No. 10/929,626, indicating relevance of listed references in this IDS.

* cited by examiner

PLASMA DISPLAY PANEL HAVING BUS ELECTRODES EXTENDING ACROSS AREAS OF NON-DISCHARGE REGIONS

CROSS REFERENCE TO RELATED APPLICATIONS

This application claims priority to and the benefit of Korea Patent Applications Nos.: 2003-0039955 filed on Jun. 19, 2003; 2003-0051009 filed on Jul. 24, 2003; 2003-0050278 filed on Jul. 22, 2003; 2003-0052598 filed on Jul. 30, 2003; and 2003-0053461 filed on Aug. 1, 2003, all filed in the Korean Intellectual Property Office, the entire contents of which are incorporated herein by reference.

This application is also related to:

(a) commonly assigned U.S. patent application Ser. No. 10/746,540 entitled "Plasma Display Panel" filed on Dec. 23, 2003, which claims priority to and the benefit of Korea Patent Applications No. 2003-0000088 filed on Jan. 2, 2003 and No. 2003-0045202 filed on Jul. 4, 2003;

(b) commonly assigned U.S. patent application Ser. No. 10/746,541 entitled "Plasma Display Panel" filed on Dec. 23, 2003 which claims priority to and the benefit of Korea Patent Application No. 2002-0084984 filed on Dec. 27, 2002, Korea Patent Application No. 2003-0050278 filed on Jul. 22, 2003 and Korea Patent Application No. 2003-0052598 filed on Jul. 30, 2003; and (c) commonly assigned U.S. patent application Ser. No. 10/751,341 entitled "Plasma Display Panel" filed on Jan. 2, 2004, which claims priority to and the benefit of Korea Patent Applications No. 2003-0000088 filed on Jan. 2, 2003, No. 2003-0045202 filed on Jul. 4, 2003, No. 2003-0045200 filed on Jul. 4, 2003, No. 2003-0050278 filed on Jul. 22, 2003, No. 2003-0052598 filed on Jul. 30, 2003, and No. 2003-0053461 filed on Aug. 1, 2003, all in the Korean Intellectual Property Office.

BACKGROUND OF THE INVENTION (a) Field of the Invention

The present invention relates to a plasma display panel (PDP), and more particularly, to a PDP having a barrier rib structure between two substrates that defines discharge cells into independent units.

(b) Description of the Related Art

A PDP is typically a display device in which ultraviolet rays generated by the discharge of gas excite phosphors to realize predetermined images. As a result of the high resolution and large screen sizes possible with PDPs, they are quickly emerging as one of the most popular flat panel display configurations.

Depending on a drive voltage applied to a discharge region, that is, depending on the discharge type, the PDP is classified into the different types of the AC-PDP and the DC-PDP. Further, the PDP is classified as an opposing discharge type PDP or a surface discharge type PDP depending on its electrode structure. The PDP having an AC surface discharge structure (i.e., AC-PDP) is becoming the standard configuration.

The general structure of the AC-PDP will now be described. In the conventional AC-PDP, address electrodes are formed along one direction on a surface of a rear substrate. A dielectric layer is formed on the rear substrate covering the address electrodes, and barrier ribs are formed on the dielectric layer. The barrier ribs are formed in a stripe pattern between the address electrodes. Formed between (and often along inner walls of) the barrier ribs are red (R), green (G), and blue (B) phosphor layers. That is, one of the R, G, and B phosphor layers is formed between each pair of barrier ribs.

Formed on a surface of a front substrate opposing the rear substrate are discharge sustain electrodes. Each of the discharge sustain electrodes includes a transparent electrode and a bus electrode. The discharge sustain electrodes are formed along a direction such that they intersect (i.e., are generally perpendicular to the direction of) the address electrodes. A dielectric layer is formed on the rear substrate covering the discharge sustain electrodes, and an MgO protection layer is formed on the dielectric layer.

Areas between where the address electrodes of the rear substrate and the discharge sustain electrodes of the front substrate intersect correspond to where discharge cells are formed.

An address voltage Va is applied between the address electrodes and the discharge sustain electrodes to perform address discharge, then a sustain voltage Vs is applied between a pair of the discharge sustain electrodes to perform sustain discharge. Vacuum ultraviolet rays generated at this time excite corresponding phosphor layers such that visible light is emitted through the transparent front substrate to realize the display of images.

However, in the PDP structured with the discharge sustain electrodes as described above and the barrier ribs provided in a stripe pattern, crosstalk may occur between adjacent discharge cells (i.e., discharge cells adjacent to one another with the barrier ribs provided therebetween). Further, since there is no structure provided between adjacent barrier ribs for dividing the discharge cells along this direction, it is possible for mis-discharge to occur between adjacent discharge cells within adjacent barrier ribs. To prevent these problems, it is necessary to provide a minimum distance between the discharge sustain electrodes corresponding to adjacent pixels. A drawback of doing so, however, is that this limits efforts at improving discharge efficiency.

In an effort to remedy these problems, PDPs having improved electrode and barrier rib structures have been disclosed.

In the PDP having an improved electrode structure, although barrier ribs are formed in the typical stripe pattern, discharge sustain electrodes are changed in configuration. That is, the discharge sustain electrodes include transparent electrodes and bus electrodes, with a pair of transparent electrodes being formed for each discharge cell in such a manner to extend from the bus electrodes and oppose one another. U.S. Pat. No. 5,661,500 discloses a PDP with such a configuration. However, mis-discharge along the direction that the barrier ribs are formed remains a problem with this PDP.

Another configuration adds an improved barrier rib structure to the above structure. In such a PDP, a matrix structure for barrier ribs is used in which the barrier ribs include vertical barrier ribs and horizontal barrier ribs that intersect one another. Japanese Laid-Open Patent No. Heisei 10-149771 discloses a PDP with such a configuration.

However, with the use of the matrix barrier rib structure described above, since all areas except for where the barrier ribs are formed are designed as discharge regions, only areas that generate heat and no areas that absorb or disperse heat are formed. As a result, after a certain amount of time has elapsed, temperature differences occur between cells in which discharge occurs and in which discharge does not occur. These temperature differences not only affect discharge characteristics, but also result in differences in brightness, the generation of bright image stickings, and other such picture quality problems. "Bright image stickings" refers to a difference in brightness occurring between a localized area and its peripheries even after a pattern of brightness that is greater than its peripheries is displayed for a predetermined time interval then returned to the brightness of the overall screen.

Further, in the PDP having the barrier ribs of such a matrix structure, either the phosphor layers are unevenly formed in corner areas that define the discharge cells, or the distance from the phosphor layers to the discharge sustain electrodes is significant enough that the efficiency of converting ultraviolet rays into visible light is reduced.

SUMMARY OF THE INVENTION

In accordance with the present invention, a plasma display panel is provided that mounts bus electrodes over non-discharge regions to the outside of discharge cells to prevent a reduction in brightness and illumination efficiency.

Further, in accordance with the present invention, a plasma display panel is provided in which an area of bus electrodes is increased in non-discharge regions such that a reflexibility of external light is reduced and contrast is enhanced.

In one embodiment of the present invention, a plasma display panel includes a first substrate and a second substrate provided opposing one another with a predetermined gap therebetween. Address electrodes are formed on the second substrate. Barrier ribs are mounted between the first substrate and the second substrate, the barrier ribs defining a plurality of discharge cells and a plurality of non-discharge regions. Phosphor layers formed within each of the discharge cells. Further, discharge sustain electrodes formed on the first substrate in a direction intersecting the address electrodes. The non-discharge regions are formed in areas encompassed by discharge cell abscissas that pass through centers of adjacent discharge cells and discharge cell ordinates that pass through centers of adjacent discharge cells. Each of the discharge cells is formed such that ends of the discharge cells gradually decrease in width along a direction the discharge sustain electrodes are formed as a distance from a center of the discharge cells is increased along a direction the address electrodes are formed. The discharge sustain electrodes include bus electrodes that extend in a direction substantially perpendicular to a direction the address electrodes are formed and outside areas of the discharge cells but across areas of the non-discharge regions, and protrusion electrodes formed extending from each of the bus electrodes such that a pair of opposing protrusion electrodes is formed within areas corresponding to each discharge cell.

The barrier ribs defining adjacent discharge cells form the non-discharge regions into a cell structure, and the non-discharge regions formed into a cell structure define discharge cells adjacent diagonally. Each of the non-discharge regions having the cell structure may be divided into a plurality of individual cells.

Each of the discharge cells is formed such that ends thereof increasingly decrease in width along a direction the discharge sustain electrodes are formed as a distance from a center of the discharge cells is increased along a direction the address electrodes are formed. Each of the ends of the discharge cells is formed in the shape of a trapezoid with its base removed, is wedge-shape, or is arc-shaped.

The protrusion electrodes are formed such that a width of proximal ends thereof corresponding to the location of the ends of the discharge cells decreases as a distance from a center of the discharge cells is increased. Each of the protrusion electrodes may be formed such that both sides of its proximal end are formed uniformly with inner walls of the corresponding discharge cell.

Distal ends of the protrusion electrodes of at least one of each pair of the discharge sustain electrodes may be indented to form indentations, thereby forming a first discharge gap and a second discharge gap of different sizes between opposing protrusion electrodes. The indentations may be formed at center areas of the distal ends of the protrusion electrodes along the direction substantially perpendicular to the direction of the address electrodes, and sections to both sides of the indentations may be protruded.

The discharge cells are filled with discharge gas containing 10% or more Xenon. In one embodiment, the discharge cells are filled with discharge gas containing 10~60% Xenon.

The barrier ribs comprise first barrier rib members formed substantially parallel to the direction of the address electrodes, and second barrier rib members formed in a direction that is not parallel to (i.e., is oblique to) the direction of the address electrodes. The second barrier rib members may be formed at a predetermined angle to the direction the address electrodes are formed to intersect over the address electrodes.

The first barrier rib members and the second barrier rib members are formed to different heights. A height of the first barrier rib members may be greater than a height of the second barrier rib members, or the height of the first barrier rib members may be less than the height of the second barrier rib members.

Ventilation paths are formed on the barrier ribs defining the non-discharge regions. The ventilation paths may be formed as grooves in the barrier ribs to communicate the discharge cells with the non-discharge regions. The grooves may have substantially an elliptical planar configuration, or substantially a rectangular planar configuration.

In another embodiment, the discharge sustain electrodes include scan electrodes and display electrodes provided such that one scan electrode and one display electrode correspond to each row of the discharge cells, the scan electrodes and the display electrodes including protrusion electrodes that extend into the discharge cells while opposing one another. The protrusion electrodes are formed such that a width of proximal ends thereof is smaller than a width of distal ends of the protrusion electrodes. Also, the address electrodes include line regions formed along a direction the address electrodes are formed, and enlarged regions formed at predetermined locations and expanding along a direction substantially perpendicular to the direction of the line regions to correspond to the shape of protrusion electrodes of the scan electrodes.

The enlarged regions of the address electrodes are formed to a first width at areas opposing the distal ends of the protrusion electrodes, and to a second width that is smaller than the first width at areas opposing the proximal ends of the protrusion electrodes.

In yet another embodiment, the discharge sustain electrodes include scan electrodes and display electrodes provided such that one scan electrode and one display electrode correspond to each row of the discharge cells. Each of the scan electrodes and display electrodes includes bus electrodes extended along a direction substantially perpendicular to the direction the address electrodes are formed, and protrusion electrodes that extend into the discharge cells from the bus electrodes such that the protrusion electrodes of the scan electrodes oppose the protrusion electrodes of the display electrodes.

One of the bus electrodes of the display electrodes is mounted between adjacent discharge cells of every other row of the discharge cells, and the bus electrodes of the scan electrodes are mounted between adjacent discharge cells and between the bus electrodes of the display electrodes.

The protrusion electrodes of the display electrodes are extended from the bus electrodes of the display electrodes into discharge cells adjacent to opposite sides of the bus electrodes, and the bus electrodes of the display electrodes have a width that is greater than a width of the bus electrodes of the scan electrodes.

In still yet another embodiment, the bus electrodes include projections that are extended from the bus electrodes in the direction the protrusion electrodes are extended. The projections of the bus electrodes are positioned between the discharge cells that are adjacent in the direction the protrusion electrodes are extended, and the projections of the bus electrodes may be extended over predetermined areas of the non-discharge regions and the barrier ribs.

DETAILED DESCRIPTION

Figure 1:
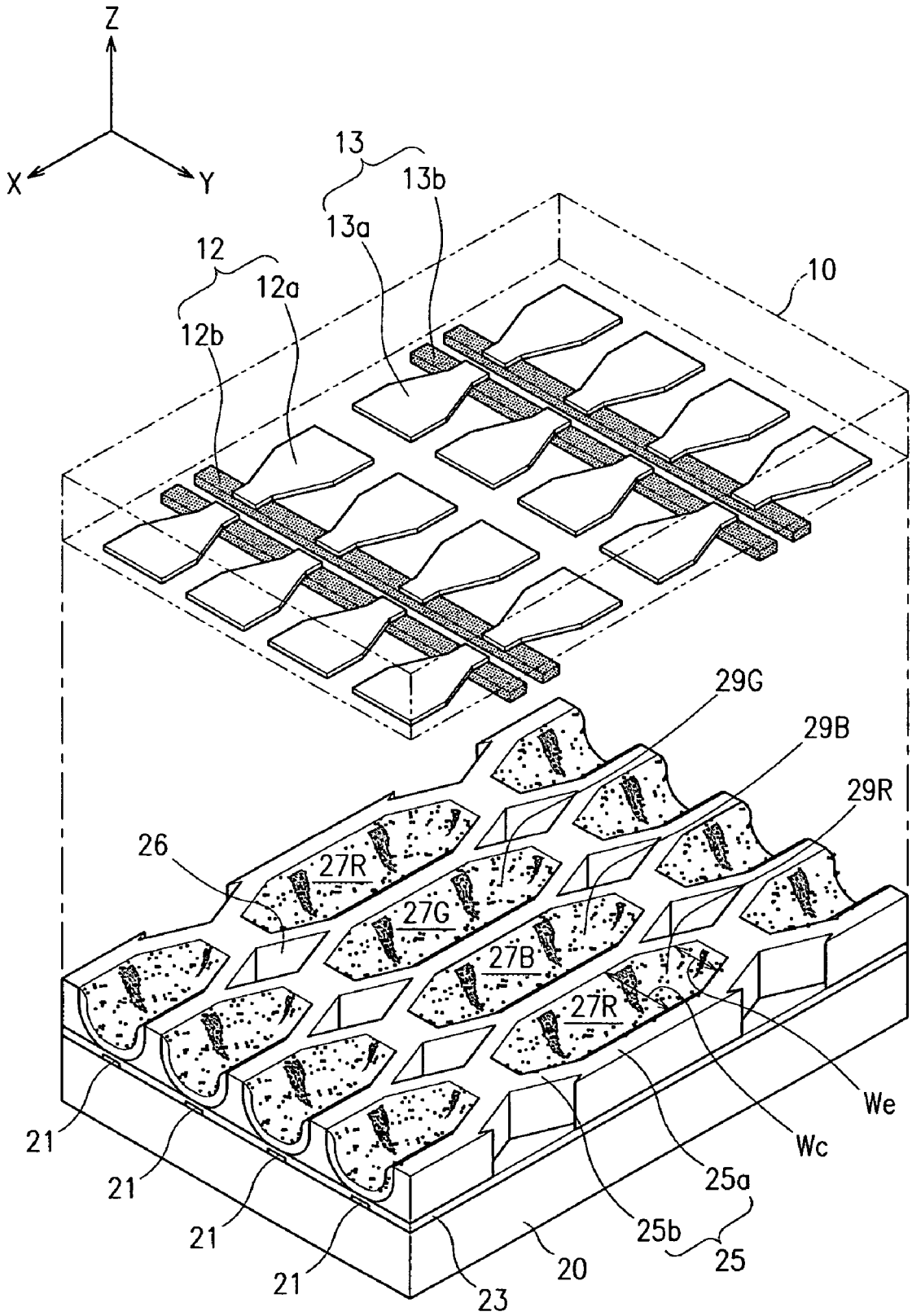
FIG. 1 is a partial exploded perspective view of a plasma display panel according to a first embodiment of the present invention.
Figure 2:
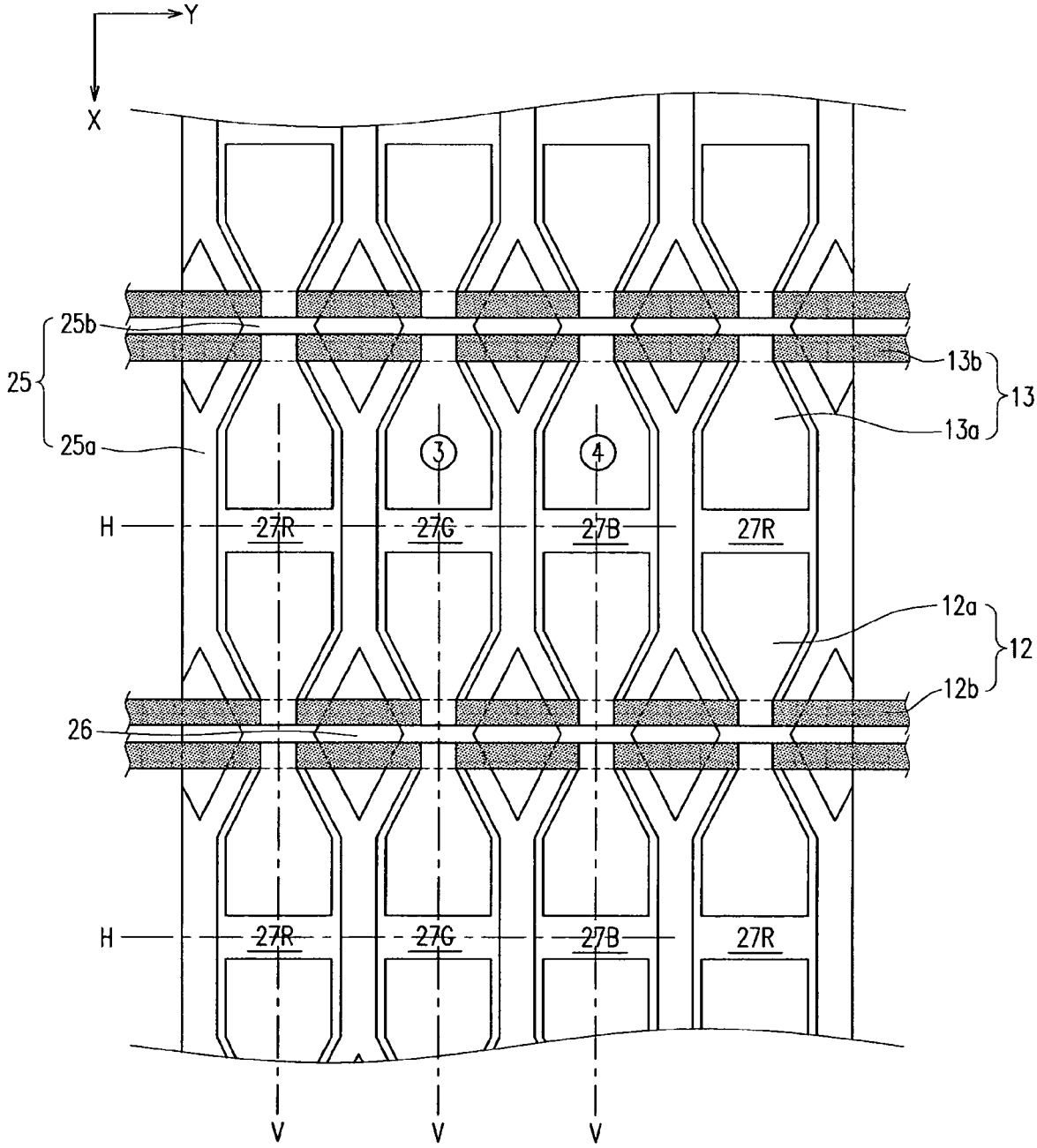
FIG. 2 is a partial plan view of the plasma display panel of FIG. 1.

Referring to FIGS. 1 and 2, a PDP according to a first embodiment includes first substrate 10 and second substrate 20 provided opposing one another with a predetermined gap therebetween. A plurality of discharge cells 27R, 27G, and 27B in which plasma discharge takes place are defined by barrier ribs 25 formed between first substrate 10 and second substrate 20. Discharge sustain electrodes 12 and 13 are formed on first substrate 10, and address electrodes 21 are formed on second substrate 20. This basic structure of the PDP will be described in greater detail below.

A plurality of address electrodes 21 are formed along one direction (direction X in the drawings) on a surface of second substrate 20 opposing first substrate 10. Address electrodes 21 are formed in a stripe pattern with a uniform, predetermined interval between adjacent address electrodes 21. Dielectric layer 23 is formed on the surface of second substrate 20 on which address electrodes 21 are formed. Dielectric layer 23 may be formed covering only address electrodes 21, or may be formed over the entire surface of second substrate 20 (covering address electrodes 21 in the process). In this embodiment, although address electrodes 21 are described as being provided in a stripe pattern, the present invention is not limited to this configuration and address electrodes 21 may be formed in a variety of different patterns and shapes.

Barrier ribs 25 define a plurality of discharge cells 27R, 27G, and 27B as described above, and also define non-discharge regions 26 in the gap between first substrate 10 and second substrate 20. In one embodiment, barrier ribs 25 are formed over dielectric layer 23, which is provided on second substrate 20 as described above. Discharge cells 27R, 27G, and 27B designate areas in which discharge gas is provided and where gas discharge is expected to take place with the application of an address voltage and a discharge sustain voltage. Non-discharge regions 26 are areas where a voltage is not applied such that gas discharge (i.e., illumination) is not expected to take place therein. Non-discharge regions 26 are areas that are at least as big as a thickness of barrier ribs 25 in direction Y.

Referring to FIGS. 1 and 2, non-discharge regions 26 defined by barrier ribs 25 are formed in areas encompassed by discharge cell abscissas H and ordinates V that pass through centers of each of discharge cells 27R, 27G, and 27B, and that are respectively aligned with direction Y and direction X. In one embodiment, non-discharge regions 26 are centered between adjacent abscissas H and adjacent ordinates V. Stated differently, in one embodiment, each pair of discharge cells 27R, 27G, and 27B adjacent to one another along direction X has common non-discharge region 26 with another such pair of discharge cells 27R, 27G, and 27B adjacent along direction Y. With this configuration realized by barrier ribs 25, each of non-discharge regions 26 has an independent cell structure.

Discharge cells 27R, 27G, and 27B adjacent in the direction discharge sustain electrodes 12 and 13 are mounted (direction Y) are formed sharing at least one of barrier ribs 25. Also, each of discharge cells 27R, 27G, and 27B is formed with ends that reduce in width in the direction of discharge sustain electrodes 12 and 13 (direction Y) as a distance from a center of each of discharge cells 27R, 27G, and 27B is increased in the direction address electrodes 21 are provided (direction X). That is, as shown in FIG. 1, width Wc of a mid-portion of discharge cells 27R, 27G, and 27B is greater than width We of the ends of discharge cells 27R, 27G, and 27B, with width We of the ends decreasing up to a certain point as the distance from the center of discharge cells 27R, 27G, and 27B is increased. Therefore, in the first embodiment, the ends of discharge cells 27R, 27G, and 27B are formed in the shape of a trapezoid (with its base removed) until reaching a predetermined location where barrier ribs 25 close off discharge cells 27R, 27G, and 27B. This results in each of discharge cells 27R, 27G, and 27B having an overall planar shape of an octagon.

Barrier ribs 25 defining non-discharge regions 26 and discharge cells 27R, 27G, and 27B in the manner described above include first barrier rib members 25*a* that are parallel to address electrodes 21, and second barrier rib members 25*b* that define the ends of discharge cells 27R, 27G, and 27B as described above and so are not parallel to address electrodes 21. In the first embodiment, second barrier rib members 25*b* are formed extending up to a point, then extending in the direction discharge sustain electrodes 12 and 13 are formed to cross over address electrodes 21. Therefore, second barrier rib members 25*b* are formed in substantially an X shape between discharge cells 27R, 27G, and 27B adjacent along the direction of address electrodes 21.

R, G, and B phosphors are deposited within discharge cells 27R, 27G, and 27B to form phosphor layers 29R, 29G, and 29B, respectively.

With respect to first substrate 10, a plurality of discharge sustain electrodes 12 and 13 are formed on the surface of first substrate 10 opposing second substrate 20. Discharge sustain electrodes 12 and 13 are extended in a direction (direction Y) substantially perpendicular to the direction (direction X) of address electrodes 21. Further, a dielectric layer is formed over an entire surface of first substrate 10 covering discharge sustain electrodes 12 and 13, and an MgO protection layer is formed on the dielectric layer. To simplify the drawings, the dielectric layer and MgO protection layer are not shown in FIGS. 1 and 2.

Discharge sustain electrodes 12 and 13 respectively include bus electrodes 12*b* and 13*b* that are formed in a stripe pattern, and protrusion electrodes 12*a* and 13*a* that are formed extended from bus electrodes 12*b* and 13*b*, respectively. For each row of discharge cells 27R, 27G, and 27B along direction Y, protrusion electrodes 12*a* overlap and protrude from corresponding bus electrode 12*b* into the areas of discharge cells 27R, 27G, and 27B, and protrusion electrodes 13*a* overlap and protrude from corresponding bus electrode 13*b* into the areas of discharge cells 27R, 27G, and 27B. Therefore, one protrusion electrode 12*a* and one protrusion electrode 13*a* are formed opposing one another in each area corresponding to each of discharge cells 27R, 27G, and 27B.

Bus electrodes 12*b* and 13*b*, as shown in FIG. 2, are mounted to the outside of the ends of discharge cells 27R, 27G, and 27B, that is, outside of the regions of discharge cells 27R, 27G, and 27B. Bus electrodes 12*b* and 13*b* do, however, overlap the areas of barrier ribs 25 between discharge cells 27R, 27G, and 27B adjacent along the direction of address electrodes 21 and extend into non-discharge regions 26.

A width of bus electrodes 12*b* and 13*b* is determined by a distance between discharge cells 27R, 27G, and 27B adjacent in the direction of address electrodes 21. For example, the width of bus electrodes 12*b* and 13*b* may be 40-150 μm. Also, protrusion electrodes 12*a* and 13*a* may be formed to a length along the direction of address electrodes 21 of 20-250 μm, and to a width along the direction substantially perpendicular to the direction of address electrodes 21 of 20-100 μm.

Protrusion electrodes 12*a* and 13*a* are realized through transparent electrodes such as ITO (indium tin oxide) electrodes. In one embodiment, metal electrodes are used for bus electrodes 12*b* and 13*b*.

With the configuration described above in which bus electrodes 12*b* and 13*b* do not pass into the regions of discharge cells 27R, 27G, and 27B but overlap areas of non-discharge regions 26, a reduction in an aperture ratio of the PDP is prevented to thereby improve brightness and illumination efficiency.

Proximal ends of protrusion electrodes 12*a* and 13*a* (i.e., where protrusion electrodes 12*a* and 13*a* are attached to and extend from bus electrodes 12*b* and 13*b*, respectively) are formed corresponding to the shape of the ends of discharge cells 27R, 27G, and 27B. That is, the proximal ends of protrusion electrodes 12*a* and 13*a* reduce in width along direction Y as the distance from the center of discharge cells 27R, 27G, and 27B along direction X is increased to thereby correspond to the shape of the ends of discharge cells 27R, 27G, and 27B.

Figure 3:
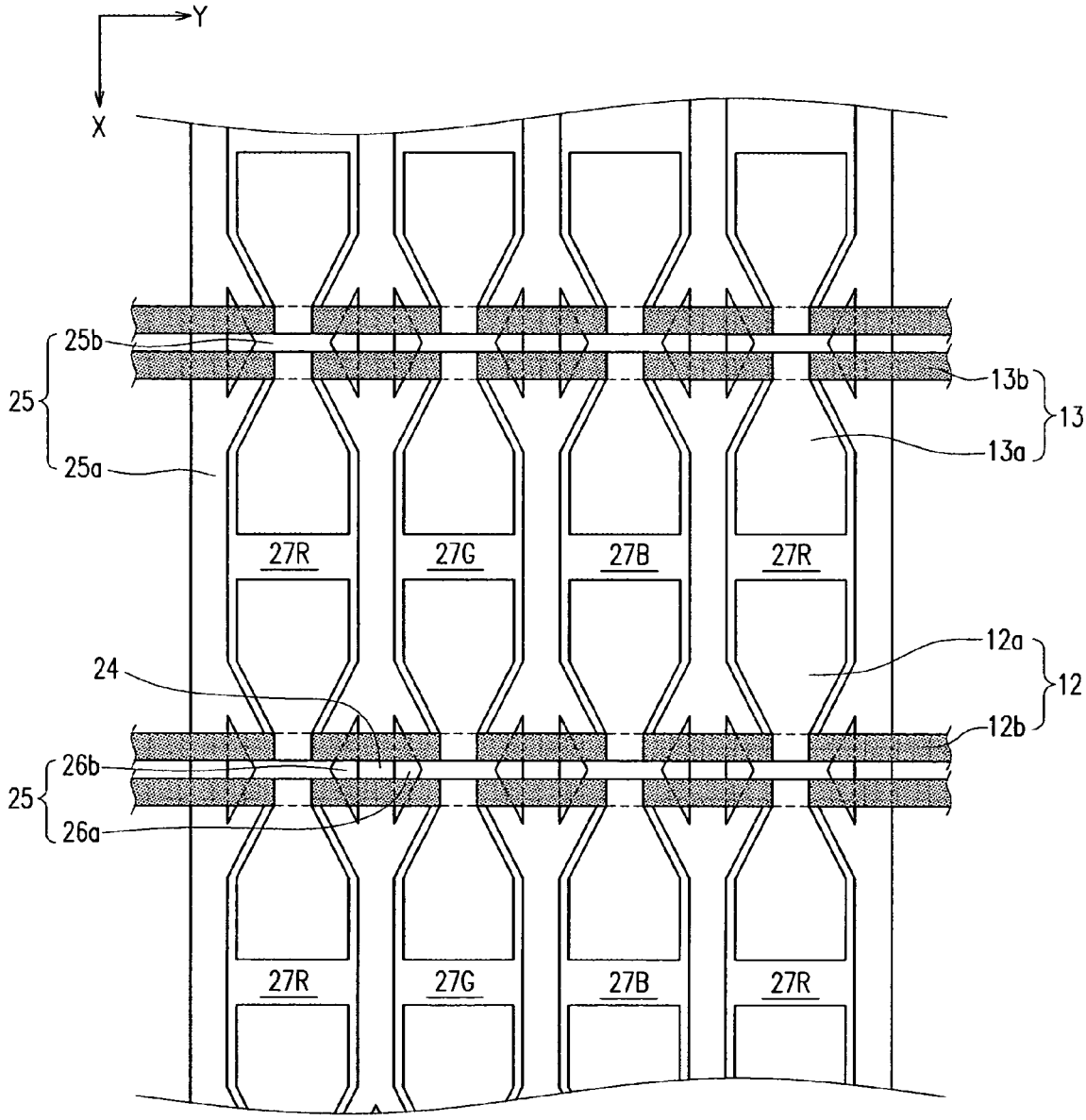
FIG. 3 is a partial plan view of a modified example of the plasma display panel embodiment of FIG. 1.

FIG. 3 is a partial plan view of a modified example of the PDP embodiment of FIG. 1. Partition barrier ribs 24 are formed in direction X passing through centers of non-discharge regions 26. Partition barrier ribs 24 may be formed by extending first barrier rib members 25*a*. With the formation of partition barrier ribs 24, non-discharge regions 26 are divided into two sections 26*a* and 26*b* forming non-discharge sub-regions. It should be noted that non-discharge regions 26 may be divided into more than the two sections depending on the number and shape of partition barrier ribs 24. Further, partition barrier ribs 24 are not limited to being formed along direction X and may also be formed along the direction of bus electrodes 12*b* and 13*b* (direction Y).

Figure 4:
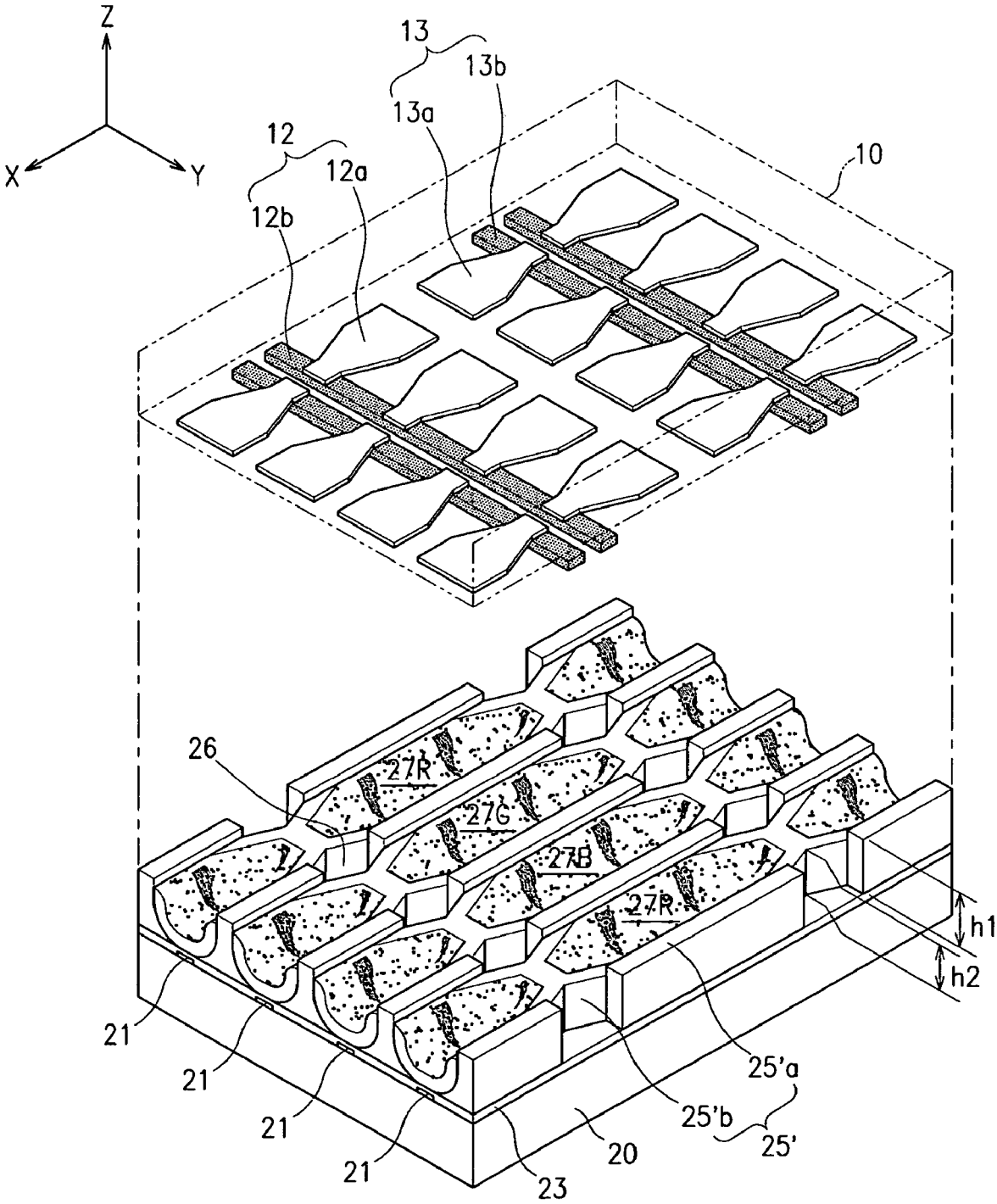
FIG. 4 is a partial exploded perspective view of another modified example of the plasma display panel embodiment of FIG. 1.

FIG. 4 is a partial exploded perspective view of another modified example of the PDP embodiment of FIG. 1. In this modified example, first barrier rib members 25'*a* and second barrier rib members 25'*b* forming barrier ribs 25' may have different heights. In particular, height h1 of first barrier rib members 25'*a* is greater than height h2 of second barrier rib members 25'*b*. As a result, exhaust spaces are formed between first substrate 10 and second substrate 20 to thereby enable more effective and smoother evacuation of the PDP during manufacture. In another modified example, it is also possible for height h1 of first barrier rib members 25'*a* to be less than height h2 of second barrier rib members 25'*b*. Such a configuration is not shown in the drawings.

In the following, PDPs according to second through ninth embodiments of the present invention will be described. In these PDPs, although the basic structure of the PDP of the first embodiment is left intact, the barrier rib structure of second substrate 20 and the discharge sustain electrode structure of first substrate 10 are changed to improve discharge efficiency. Like reference numerals will be used in the following description for elements identical to those of the first embodiment.

Figure 5:
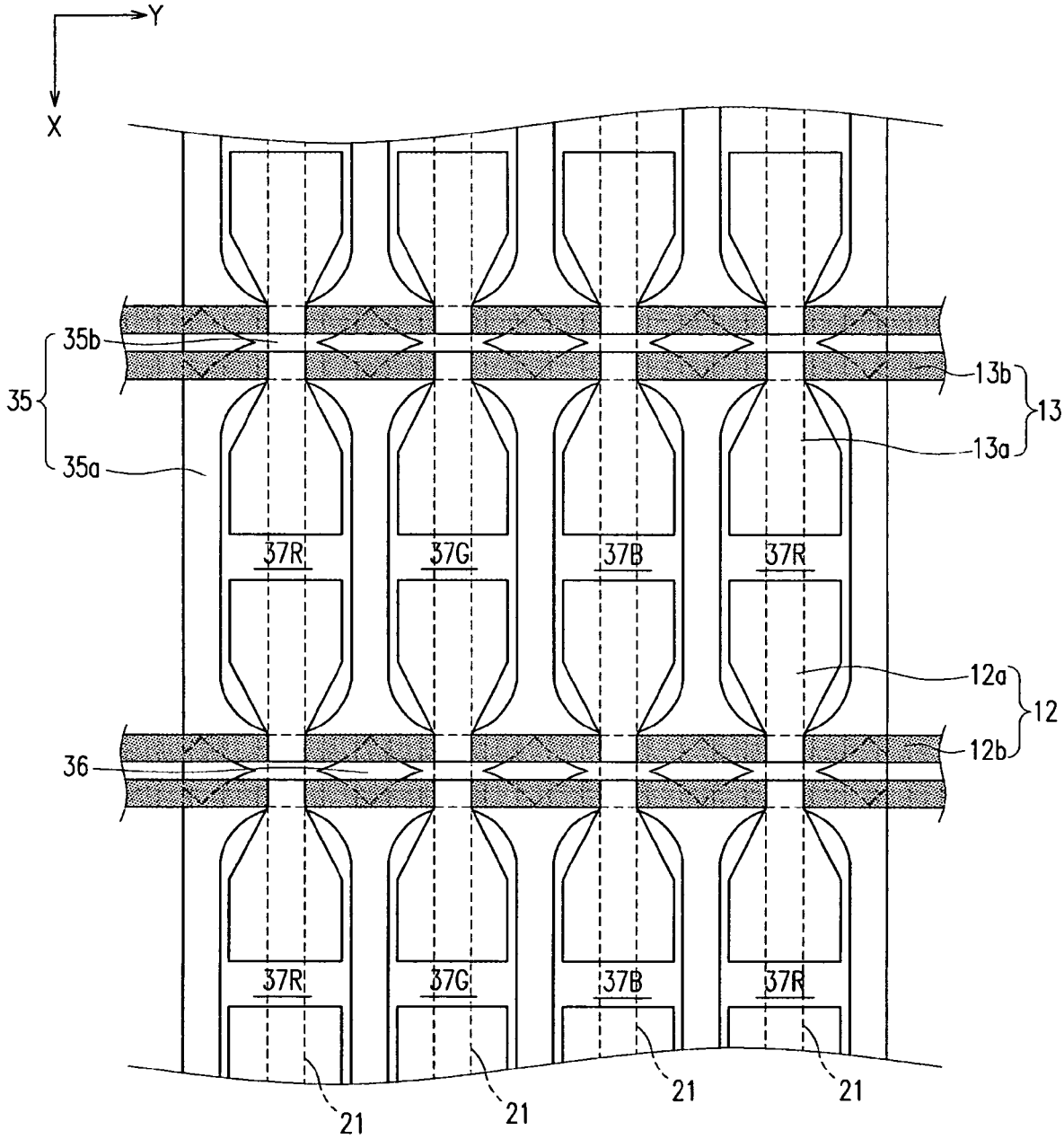
FIG. 5 is a partial plan view of a plasma display panel according to a second embodiment of the present invention.

FIG. 5 is a partial plan view of a plasma display panel according to a second embodiment of the present invention.

In the PDP according to the second embodiment, a plurality of non-discharge regions 36 and a plurality of discharge cells 37R, 37G, and 37B are defined by barrier ribs 35 which include first barrier members 35*a* and second barrier members 35*b*. Non-discharge regions 36 are formed in areas encompassed by discharge cell abscissas and ordinates that pass through centers of each of discharge cells 37R, 37G, and 37B, and that are aligned respectively with directions X and Y as in the first embodiment.

Ends of discharge cells 37R, 37G, and 37B are formed reducing in width in the direction of discharge sustain electrodes 12 and 13 (direction Y) as a distance from a center of each of discharge cells 37R, 37G, and 37B is increased in the direction that address electrodes 21 are provided (direction X). This reduction in width is realized gradually such that the ends of discharge cells 37R, 37G, and 37B are arc-shaped.

Discharge sustain electrodes 12 and 13 include bus electrodes 12*b* and 13*b*, respectively, that are formed along a direction (direction Y) that is substantially perpendicular to the direction address electrodes 21 are formed (direction X), and protrusion electrodes 12*a* and 13*a*, respectively. Bus electrodes 12*b* and 13*b*, are mounted to the outside of the ends of discharge cells 37R, 37G, and 37B, that is, outside of the regions of discharge cells 37R, 37G, and 37B. Bus electrodes 12*b* and 13*b* do, however, overlap the areas of barrier ribs 35 between discharge cells 37R, 37G, and 37B adjacent along the direction of address electrodes 21 and extend into non-discharge regions 36.

Further, for each row of discharge cells 37R, 37G, and 37B along direction Y, protrusion electrodes 12*a* overlap and protrude from corresponding bus electrode 12*b* into the area of discharge cells 37R, 37G, and 37B. Similarly, the protrusion electrodes 13*a* overlap and protrude from corresponding bus electrode 13*b* into the area of discharge cells 37R, 37G, and 37B. Therefore, one protrusion electrode 12*a* and one protrusion electrode 13*a* are formed opposing one another in each area corresponding to each of discharge cells 37R, 37G, and 37B.

Proximal ends of protrusion electrodes 12*a* and 13*a* (i.e., where protrusion electrodes 12*a* and 13*a* are attached to and extended from bus electrodes 12*b* and 13*b*, respectively) are formed reducing in width in the direction of discharge sustain electrodes 12 and 13 (direction Y) as a distance from a center of each of discharge cells 37R, 37G, and 37B is increased in the direction that address electrodes 21 are provided (direction X). The change in width is made abruptly so that the proximal ends of protrusion electrodes 12*a* and 13*a* are formed into a wedge shape as in the first embodiment. However, the second embodiment is not limited to this configuration and the proximal ends of protrusion electrodes 12*a* and 13*a* may be, for example, arc-shaped.

Figure 6:
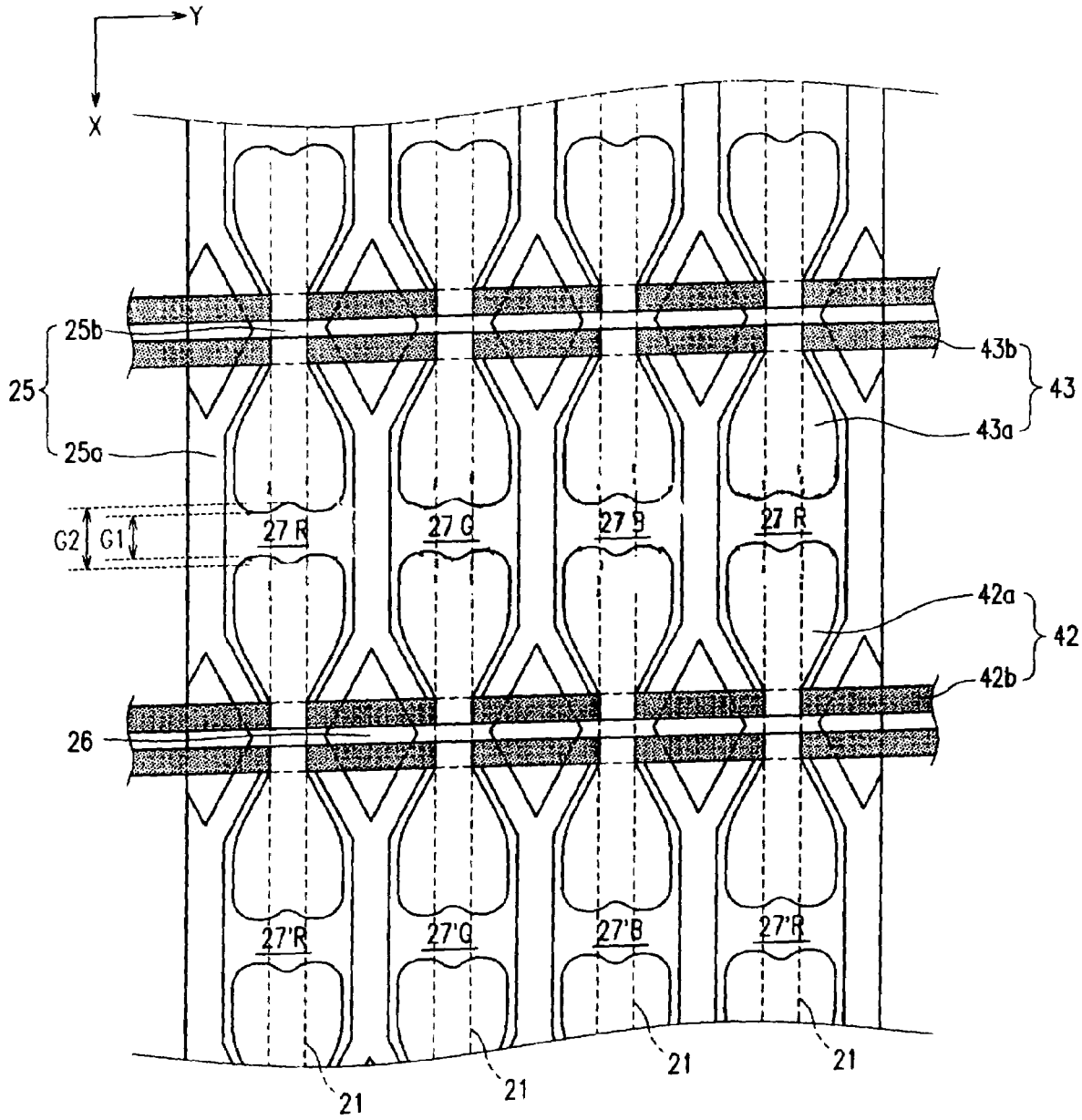
FIG. 6 is a partial plan view of a plasma display panel according to a third embodiment of the present invention.

FIG. 6 is a partial plan view of a plasma display panel according to a third embodiment of the present invention.

Discharge sustain electrodes 42 and 43 include bus electrodes 42*b* and 43*b*, respectively, that are formed along a direction (direction Y) that is substantially perpendicular to direction address electrodes 21 are formed (direction X), and protrusion electrodes 42*a* and 43*a*, respectively. Bus electrodes 42*b* and 43*b* are mounted to the outside of the ends of discharge cells 27R, 27G, and 27B, that is, outside of the regions of discharge cells 27R, 27G, and 27B. Bus electrodes 42*b* and 43*b* do, however, overlap the areas of barrier ribs 25 between discharge cells 27R, 27G, and 27B adjacent along the direction of address electrodes 21 and extend into non-discharge regions 26.

Further, for each row of discharge cells 27R, 27G, and 27B along direction Y, protrusion electrodes 42*a* overlap and protrude from corresponding bus electrode 42*b* into the area of discharge cells 27R, 27G, and 27B. Similarly, protrusion electrodes 43*a* overlap and protrude from corresponding bus electrode 43*b* into the area of discharge cells 27R, 27G, and 27B. Therefore, one protrusion electrode 42*a* and one protrusion electrode 43*a* are formed opposing one another in each area corresponding to each of discharge cells 27R, 27G, and 27B.

Proximal ends of protrusion electrodes 42*a* and 43*a* (i.e., where protrusion electrodes 42*a* and 43*a* are attached to and extended from bus electrodes 42*b* and 43*b*, respectively) are formed reducing in width in the direction of discharge sustain electrodes 42 and 43 (direction Y) as a distance from a center of each of discharge cells 27R, 27G, and 27B is increased in the direction that address electrodes 21 are provided (direction X). The change in width is made abruptly so that the proximal ends of protrusion electrodes 42*a* and 43*a* are formed into a wedge shape as in the first embodiment.

In addition, distal ends of protrusion electrodes 42*a* and 43*a* are formed such that center areas along direction Y are indented and sections to both sides of the indentations are protruded. Therefore, in each of discharge cells 27R, 27G, and 27B, first discharge gap G1 and second discharge gap G2 of different sizes are formed between opposing protrusion electrodes 42*a* and 43*a*. That is, second discharge gaps G2 (or long gaps) are formed where the indentations of protrusion electrodes 42*a* and 43*a* oppose one another, and first discharge gaps G1 (or short gaps) are formed where the protruded areas to both sides of the indentations of protrusion electrodes 42*a* and 43*a* oppose one another. Accordingly, plasma discharge, which initially occurs at center areas of discharge cells 27R, 27G, and 27B, is more efficiently diffused such that overall discharge efficiency is increased.

The distal ends of protrusion electrodes 42*a* and 43*a* may be formed with only indented center areas such that protruded sections are formed to both sides of the indentations, or may be formed with the protrusions to both sides of the indentations extending past reference straight line r formed along direction Y. Further, protrusion electrodes 42*a* and 43*a* providing the pair of the same positioned within each of discharge cells 27R, 27G, and 27B may be formed as described above, or only one of the pair may be formed with the indentations and protrusions. Regardless of the particular configuration used, in one embodiment edges of the indentations and protrusions of the protrusion electrodes 42*a* and 43*a* are rounded with no abrupt changes in angle.

Bus electrodes 42*b* and 43*b* are formed along a direction (direction Y) that is substantially perpendicular to the direction address electrodes 21 are formed (direction X), and are mounted to the outside of the ends of discharge cells 27R, 27G, and 27B, that is, outside of the regions of discharge cells 27R, 27G, and 27B. Bus electrodes 42*b* and 43*b* do, however, overlap the areas of barrier ribs 25 between discharge cells 27R, 27G, and 27B adjacent along the direction of address electrodes 21 and extend into non-discharge regions 26.

All other aspects of the third embodiment such as the shape of discharge cells 27R, 27G, and 27B, and the positioning of discharge cells 27R, 27G, and 27B relative to non-discharge regions 26 are identical to the first embodiment.

It is to be noted that in addition to the changes in shape and interrelation with other elements of the discharge cells and protrusion electrodes of the second and third embodiments as described above, it is also possible to apply the variations as described in the modified examples of the first embodiment. That is, the separated structure of the non-discharge regions as shown in FIG. 3 may be applied to the second and third embodiments, as well as the different heights of the first and second barrier rib members as shown in FIG. 4. Any combination of these configurations is also applicable to the second and third embodiments of the present invention.

In the third embodiment, discharge sustain electrodes 42 and 43 are positioned with first and second gaps G1 and G2 interposed therebetween to thereby reduce a discharge firing voltage Vf. Accordingly, in the third embodiment, the amount of Xe contained in the discharge gas may be increased while leaving the discharge firing voltage Vf at the same level. The discharge gas contains 10% or more Xe. In one embodiment, the discharge gas contains 10~60% Xe. With the increased Xe content, vacuum ultraviolet rays may be emitted with a greater intensity to thereby enhance screen brightness.

Figure 7:
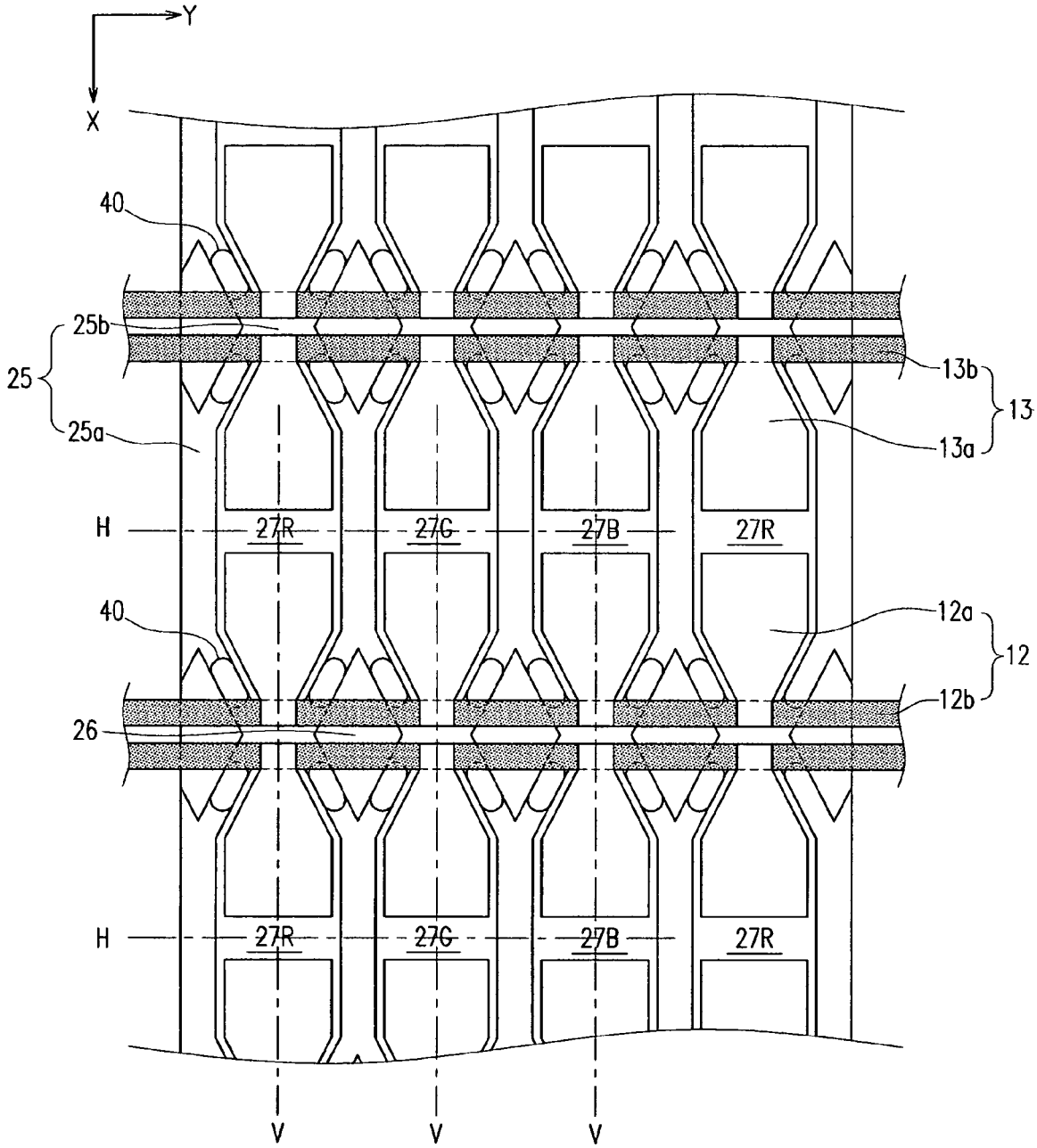
FIG. 7 is a partial plan view of a plasma display panel according to a fourth embodiment of the present invention.

FIG. 7 is a partial plan view of a plasma display panel according to a fourth exemplary embodiment of the present invention.

In the PDP according to the fourth embodiment, barrier ribs 25 define non-discharge regions 26 and discharge cells 27R, 27G, and 27B as in the first embodiment. Barrier ribs 25 include first barrier rib members 25*a* that are parallel to address electrodes 21, and second barrier rib members 25*b* that define ends of discharge cells 27R, 27G, and 27B, are not parallel to address electrodes 21, and intersect over address electrodes 21.

Discharge sustain electrodes 12 and 13 include bus electrodes 12*b* and 13*b*, respectively, that are formed along a direction (direction Y) that is substantially perpendicular to the direction address electrodes 21 are formed (direction X), and protrusion electrodes 12*a* and 13*a*, respectively. Bus electrodes 12*b* and 13*b* are mounted to the outside of the ends of discharge cells 27R, 27G, and 27B, that is, outside of the regions of discharge cells 27R, 27G, and 27B. Bus electrodes 12*b* and 13*b* do, however, overlap the areas of barrier ribs 25 between discharge cells 27R, 27G, and 27B adjacent along the direction of address electrodes 21 and extend into non-discharge regions 26.

Ventilation paths 40 are formed on second barrier rib members 25*b*. Ventilation paths 40 allow for more effective and smoother evacuation of the PDP during manufacture. Further, ventilation paths 40 are formed as grooves on second barrier rib members 25*b* such that non-discharge regions 26 and discharge cells 27R, 27G, and 27B are in communication.

Figure 8A:
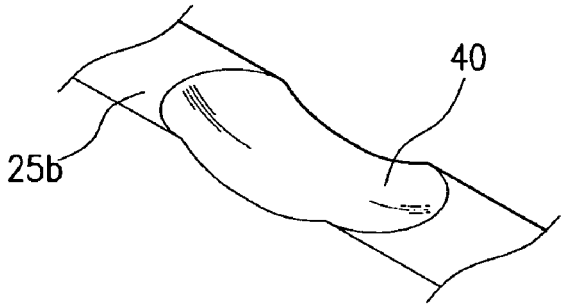
FIGS. 8A and 8B are respectively a perspective view and a plan view of a ventilation path formed in a barrier rib of the plasma display panel of FIG. 7.
Figure 8B:
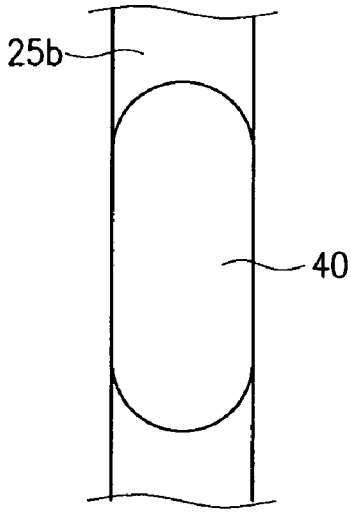
Figure 9A:
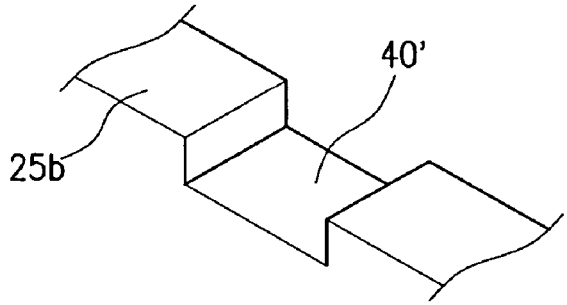
FIGS. 9A and 9B are respectively a perspective view and a plan view of a ventilation path formed in a barrier rib according to a modified example of the plasma display panel embodiment of FIG. 7.
Figure 9B:
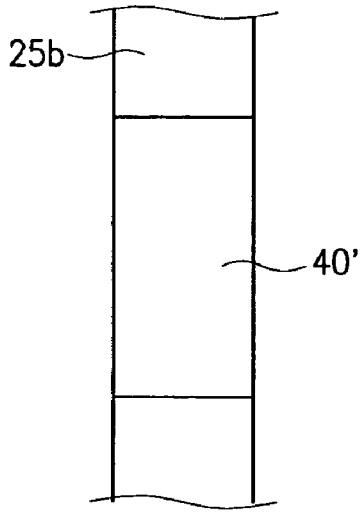

When viewed from above, the grooves forming ventilation paths 40 may be substantially elliptical as shown in FIGS. 8A and 8B, or may be substantially rectangular grooves 40' as shown in FIGS. 9A and 9B. However, the grooves are not limited to any one shape and may be formed in a variety of ways as long as there is communication between non-discharge regions 26 and discharge cells 27R, 27G, and 27B.

In the PDP having ventilation paths 40, 40' as described above, air in the PDP including air in discharge cells 27R, 27G, and 27B may be easily evacuated to thereby result in a more complete vacuum state within the PDP. Further, although four ventilation paths 40 are shown in FIG. 7 as being formed for each of discharge cells 27R, 27G, and 27B, a greater or lesser number of ventilation paths 40 may be formed as needed.

Ventilation paths 40, 40' may be applied to PDPs having various barrier rib structures that are altered from the basic configuration described with reference to the first embodiment.

Figure 10:
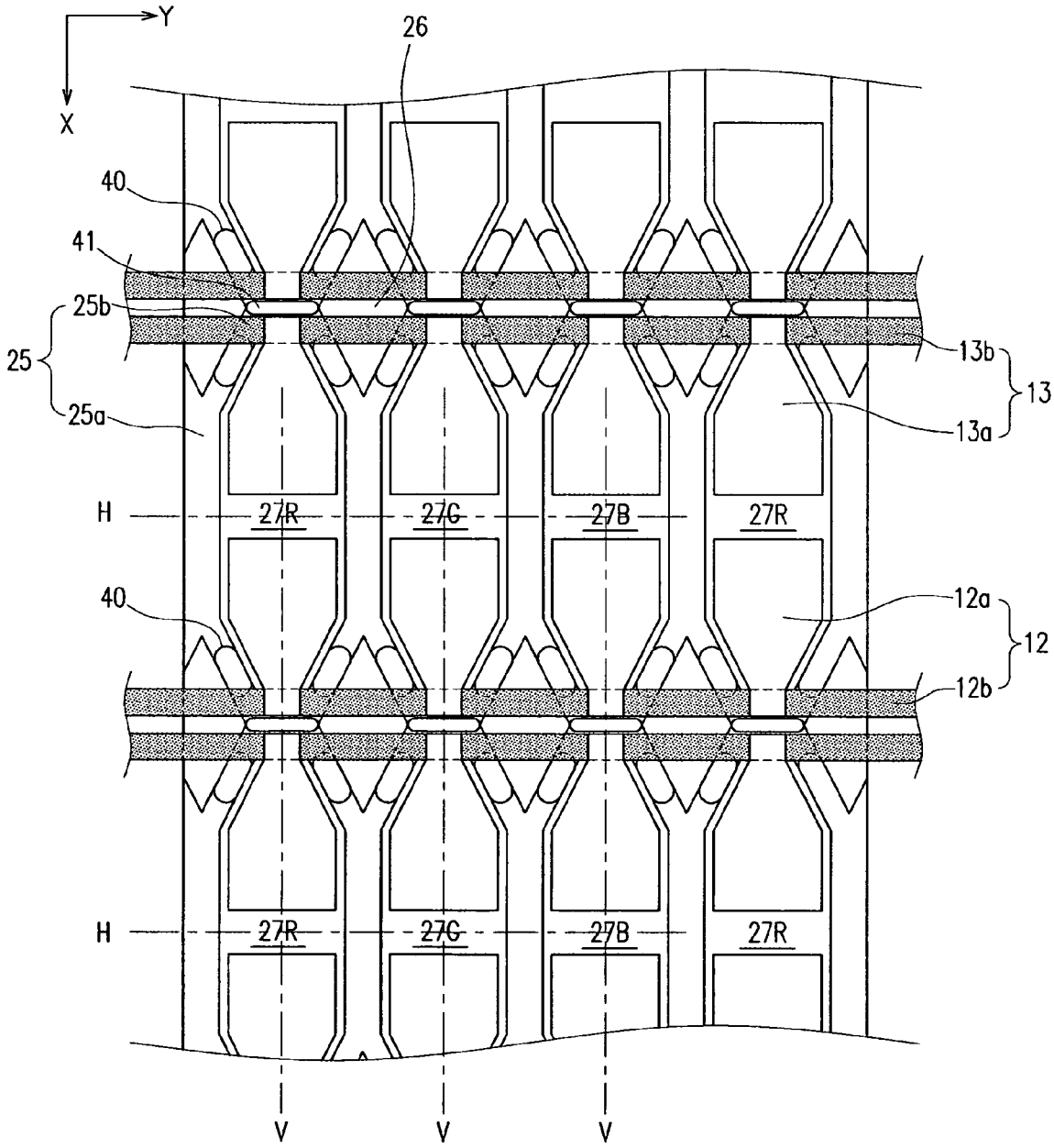
FIG. 10 is a partial plan view of another modified example of the plasma display panel embodiment of FIG. 7.

FIG. 10 is a partial plan view of another modified example of the plasma display panel embodiment of FIG. 7.

Auxiliary ventilation paths 41 are formed on second barrier rib members 25*b* that define non-discharge regions 26. Auxiliary ventilation paths 41 communicate non-discharge regions 26 adjacent along direction Y. Further, auxiliary ventilation paths 41 further enable easy evacuation of the PDP during manufacture. Similar to ventilation paths 40, auxiliary ventilation paths 41 may be substantially elliptical or rectangular when viewed from above.

Auxiliary ventilation paths 41 may be applied to various barrier rib structures in addition to the barrier rib structure shown in FIG. 10.

Figure 11:
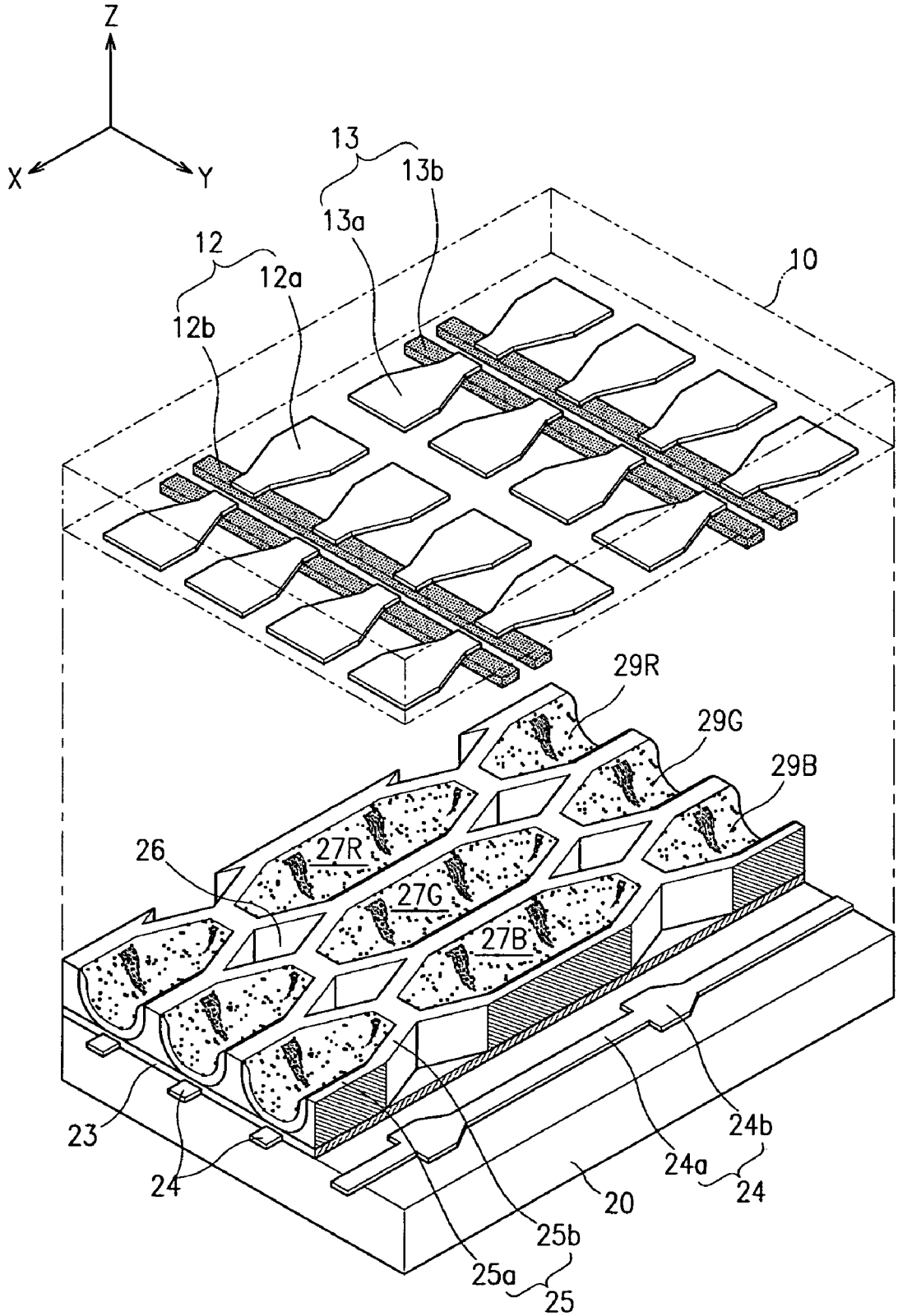
FIG. 11 is a partial exploded perspective view of a plasma display panel according to a fifth embodiment of the present invention.
Figure 12:
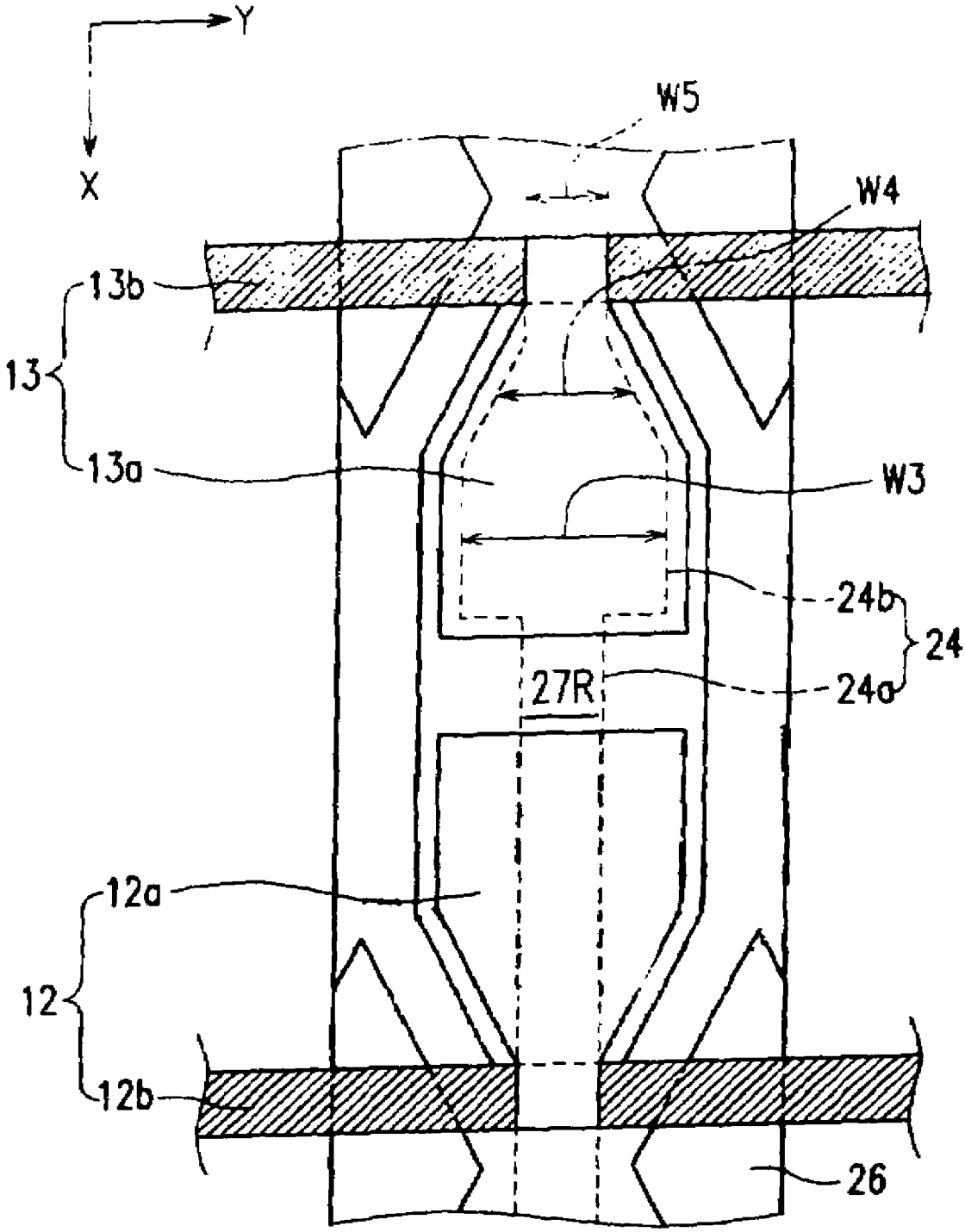
FIG. 12 is a partial enlarged plan view of a select portion of the plasma display panel embodiment of FIG. 11.

FIG. 11 is a partial exploded perspective view of a plasma display panel according to a fifth embodiment of the present invention, and FIG. 12 is a partial enlarged plan view of a select portion of the plasma display panel of FIG. 11.

In the PDP according to the fifth embodiment, barrier ribs 25 define non-discharge regions 26 and discharge cells 27R, 27G, and 27B as in the first embodiment. Further, discharge sustain electrodes 12 and 13 are formed along a direction (direction Y) substantially perpendicular to the direction address electrodes 24 are formed. Discharge sustain electrodes 12 and 13 include bus electrodes 12*b* and 13*b*, respectively, that are formed along a direction (direction Y) that is substantially perpendicular to the direction address electrodes 24 are formed (direction X), and protrusion electrodes 12*a* and 13*a*, respectively.

Bus electrodes 12*b* and 13*b* are mounted to the outside of the ends of discharge cells 27R, 27G, and 27B, that is, outside of the regions of discharge cells 27R, 27G, and 27B. Bus electrodes 12*b* and 13*b* do, however, overlap the areas of barrier ribs 25 between discharge cells 27R, 27G, and 27B adjacent along the direction of address electrodes 21 and extend into non-discharge regions 26. Protrusion electrodes 12*a* and 13*a* are formed extended from bus electrodes 12*b* and 13*b*, respectively. For each row of discharge cells 27R, 27G, and 27B along direction Y, protrusion electrodes 12*a* overlap and protrude from corresponding bus electrode 12*b* into the areas of discharge cells 27R, 27G, and 27B, and protrusion electrodes 13*a* overlap and protrude from corresponding bus electrode 13*b* into the areas of discharge cells 27R, 27G, and 27B. Therefore, one protrusion electrode 12*a* and one protrusion electrode 13*a* are formed opposing one another in each area corresponding to each of discharge cells 27R, 27G, and 27B.

Discharge sustain electrodes 12 function as display electrodes, and discharge sustain electrodes 13 function as scan electrodes.

In the fifth embodiment, address electrodes 24 include enlarged regions 24*b* formed corresponding to the shape and location of protrusion electrodes 13*a* of scan electrodes 13. Enlarged regions 24*b* increase an area of scan electrodes 13 that oppose address electrodes 24. In more detail, address electrodes 24 include line regions 24*a* formed along direction X, and enlarged regions 24*b* formed at predetermined locations and expanding along direction Y corresponding to the shape of protrusion electrodes 13*a* as described above.

As shown in FIG. 12, when viewed from a front of the PDP, areas of enlarged regions 24*b* of address electrodes 24 opposing distal ends of protrusions 13*a* of scan electrodes 13 are substantially rectangular having width W3, and areas of enlarged regions 24*b* of address electrodes 24 opposing the proximal ends of protrusions 13*a* of scan electrodes 13 are substantially wedge-shaped having width W4 that is less than width W3 and decreases gradually as bus electrodes 13*b* are neared. With width W5 corresponding to the width of line regions 24*a* of address electrodes 24, the following inequalities are maintained: W3>W5 and W4>W5.

With the formation of enlarged regions 24*b* at areas opposing scan electrodes 13 of address electrodes 24 as described above, address discharge is activated when an address voltage is applied between address electrodes 24 and scan electrodes 13, and the influence of display electrodes 12 is not received. Accordingly, in the PDP of the tenth embodiment, address discharge is stabilized such that crosstalk is prevented during address discharge and sustain discharge, and an address voltage margin is increased.

Figure 13:
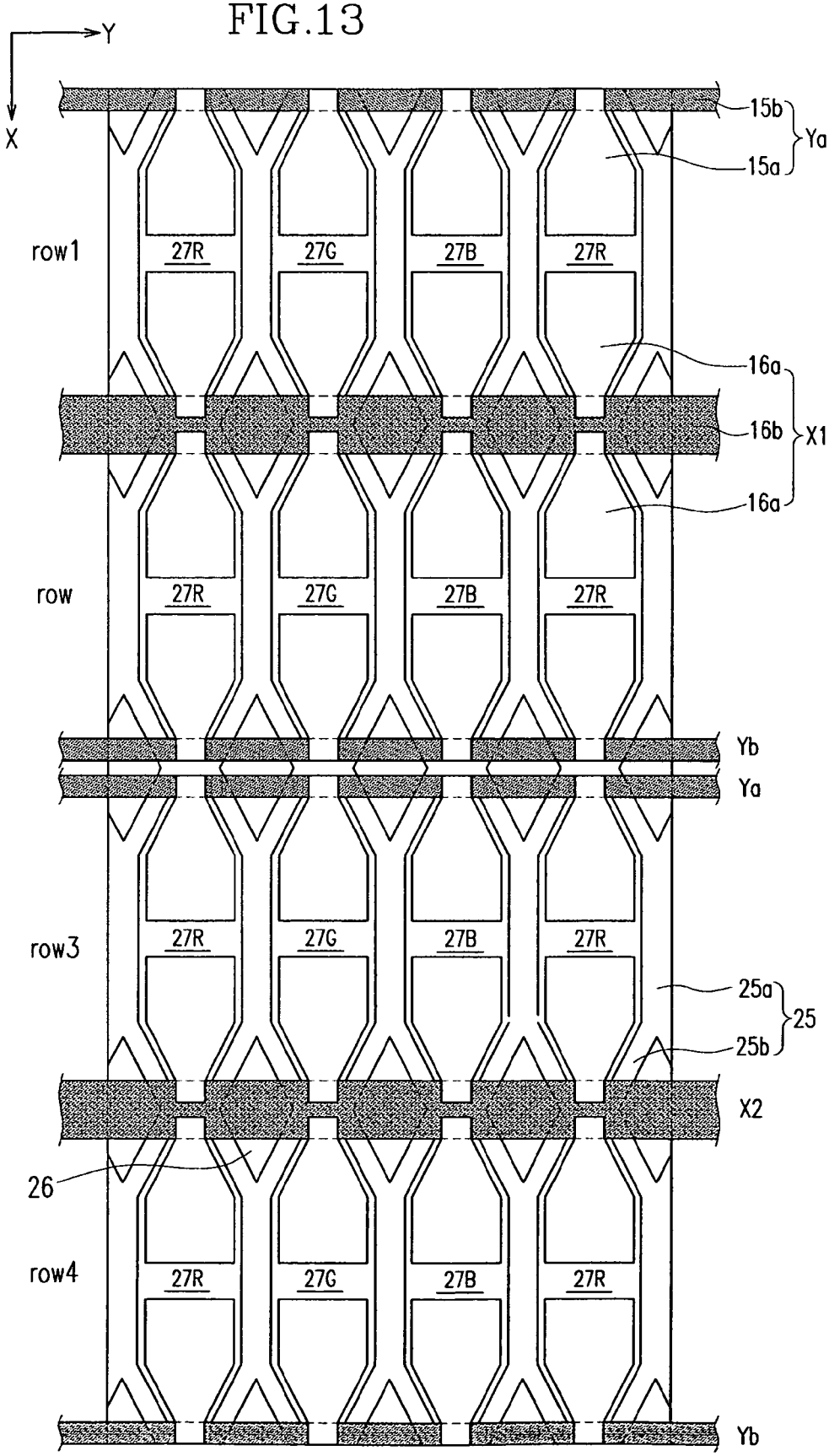
FIG. 13 is a partial plan view of a plasma display panel according to a sixth embodiment of the present invention.

FIG. 13 is a partial plan view of a plasma display panel according to a sixth embodiment of the present invention.

In the PDP according to the sixth embodiment, barrier ribs 25 define non-discharge regions 26 and discharge cells 27R, 27G, and 27B as in the first embodiment. Further, discharge sustain electrodes are formed along a direction (direction Y) substantially perpendicular to the direction address electrodes 21 are formed. The discharge sustain electrodes include scan electrodes Ya, Yb and display electrodes Xn (where n=1,2,3, . . . ). Scan electrodes Ya, Yb and display electrodes Xn include bus electrodes 15*b* and 16*b*, respectively, that extend along the direction address electrodes 21 are formed (direction Y), and protrusion electrodes 15*a* and 16*a*, respectively, that are extended respectively from bus electrodes 15*b* and 15*b* such that a pair of protrusion electrodes 15*a* and 16*a* oppose one another in each discharge cell 27R, 27G, and 27B. Bus electrodes 15*b* and 16*b* are mounted to the outside of the ends of discharge cells 27R, 27G, and 27B, that is, outside of the regions of discharge cells 27R, 27G, and 27B. Bus electrodes 15*b* and 16*b* do, however, overlap the areas of barrier ribs 25 between discharge cells 27R, 27G, and 27B adjacent along the direction of address electrodes 21 and extend into non-discharge regions 26.

Scan electrodes Ya, Yb act together with address electrodes 21 to select discharge cells 27R, 27G, and 27B, and display electrodes Xn act to perform discharge firing and generate sustain discharge.

Letting the term "rows" be used to describe lines of discharge cells 27R, 27G, and 27B adjacent along direction Y, bus electrodes 16*b* of display electrodes Xn are provided such that one of bus electrodes 16*b* is formed overlapping the areas between discharge cells 27R, 27G, and 27B in every other pair of rows adjacent along direction X. Further, bus electrodes 15*b* of scan electrodes Ya, Yb are provided such that one bus electrode 15*b* of scan electrodes Ya and one bus electrode 15*b* of scan electrodes Y*b* are formed between ends of discharge cells 27R, 27G, and 27B in every other pair of rows adjacent along direction X. Along this direction X, scan electrodes Ya, Yb and display electrodes Xn are provided in an overall pattern of Ya-X1-Yb-Ya-X2-Yb-Ya-X3-Yb- . . . Ya-Xn-Yb. With this configuration, display electrodes Xn are able to participate in the discharge operation of all discharge cells 27R, 27G, and 27B.

Further, bus electrodes 16*b* of display electrodes Xn are formed covering a greater area along direction X than pairs of bus electrodes 15*b* of scan electrodes Ya, Yb. This is because bus electrodes 16*b* of display electrodes Xn absorb outside light to thereby improve contrast.

Figure 14:
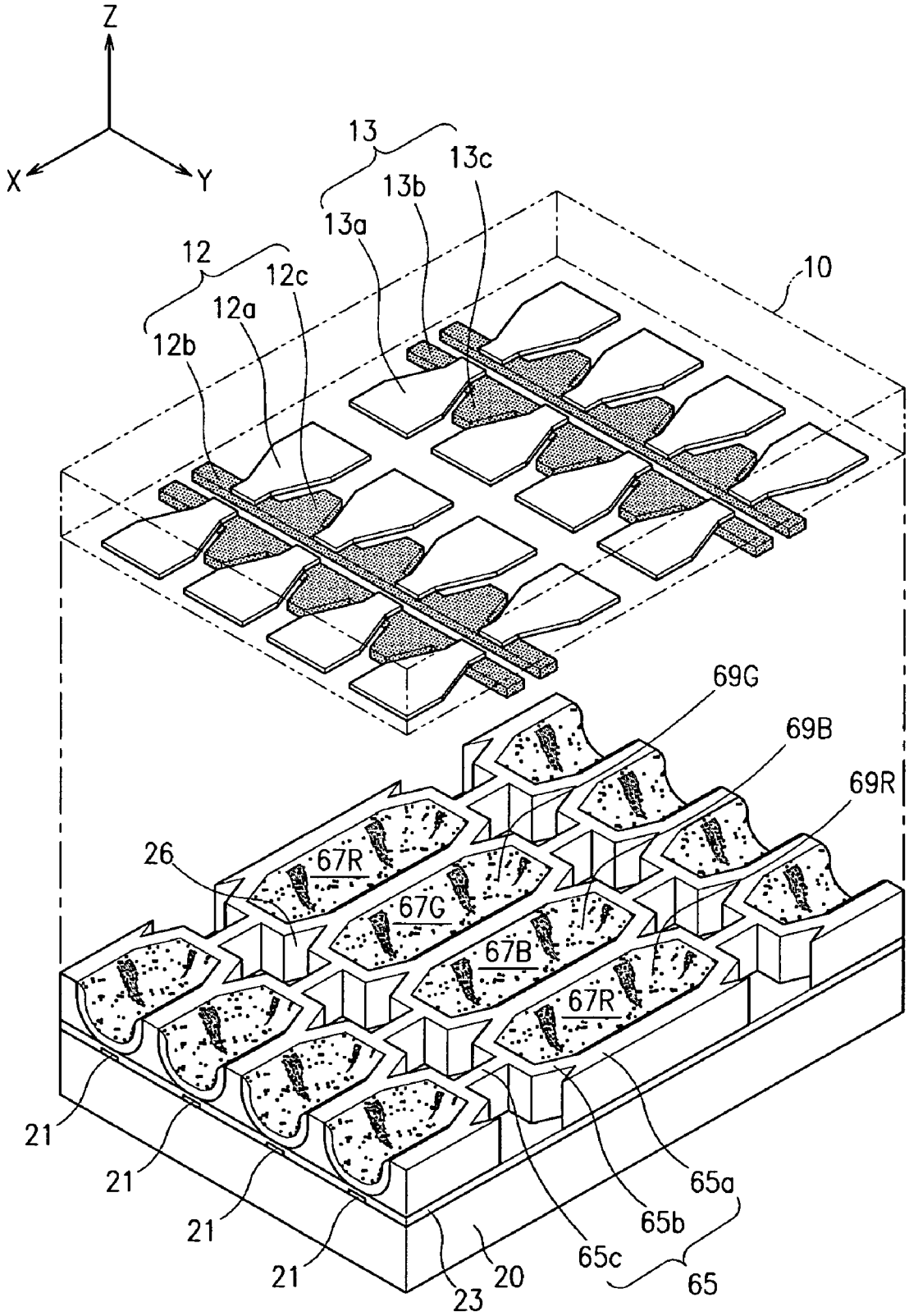
FIG. 14 is a partial exploded perspective view of a plasma display panel according to a seventh embodiment of the present invention.
Figure 15:
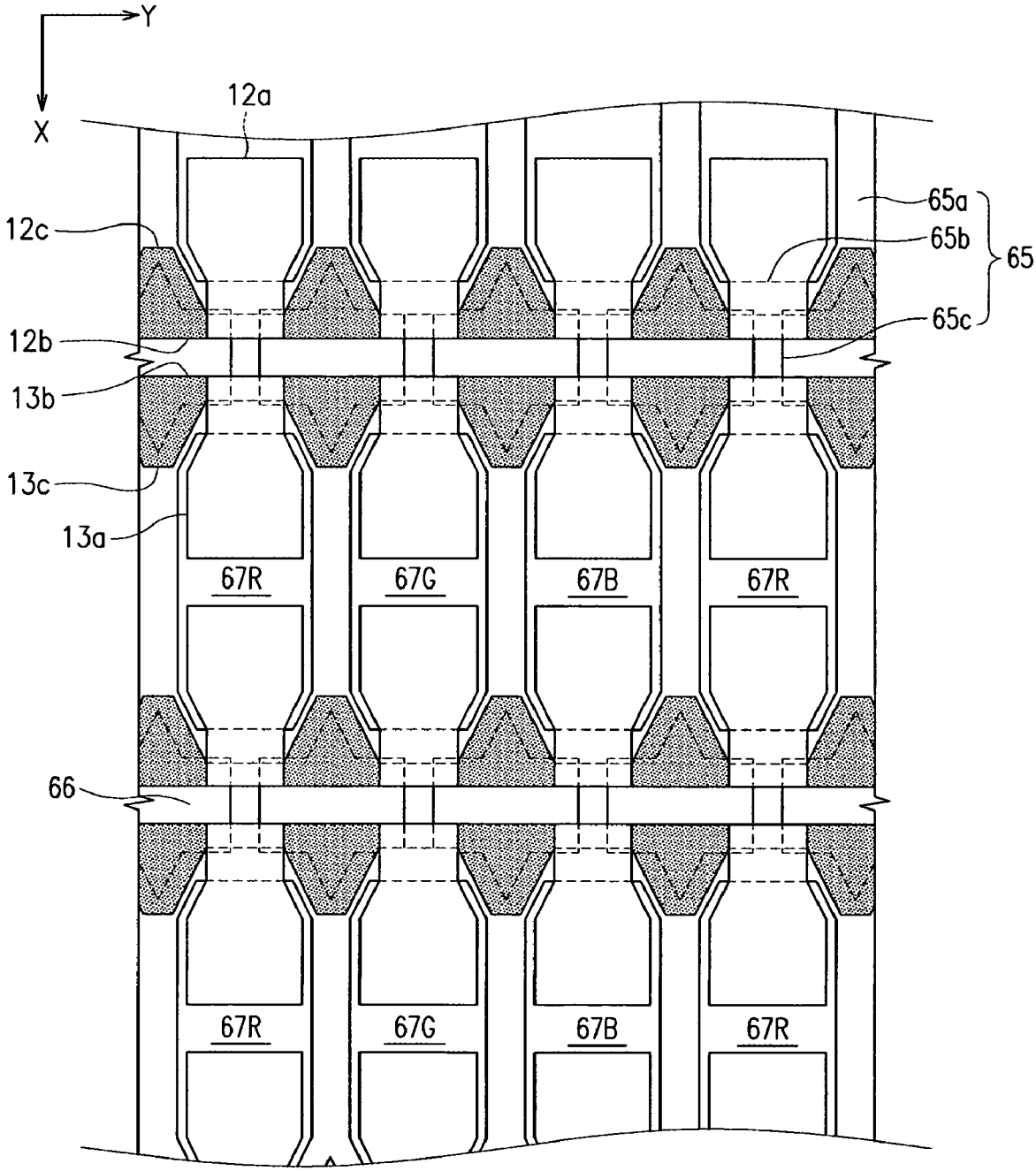
FIG. 15 is a partial plan view of the plasma display panel embodiment of FIG. 14.

FIG. 14 is a partial exploded perspective view of a PDP according to a seventh embodiment of the present invention, and FIG. 15 is a partial plan view of the plasma display panel of FIG. 14.

In the PDP according to the seventh embodiment, barrier ribs 65 are formed on second substrate 20 defining non-discharge regions 66 and discharge cells 67R, 67G, and 67B as in the first embodiment. R, G, and B phosphors are deposited within discharge cells 67R, 67G, and 67B to form phosphor layers 69R, 69G, and 69B, respectively. Barrier ribs 65 include first barrier rib members 65*a* formed along the direction of address electrodes 21 (direction X), second barrier rib members 65*b* formed along a direction that is not parallel to the direction of address electrodes 21, and third barrier rib members 65*c* for interconnecting second barrier rib members 65*b* that are adjacent along the direction of address electrodes 21. Second barrier rib members 65*b* are formed crossing over address electrodes 21.

Discharge sustain electrodes 12 and 13 are formed on first substrate 10 along a direction (direction Y) substantially perpendicular to the direction address electrodes 21 are formed. Discharge sustain electrodes 12 and 13 include bus electrodes 12*b* and 13*b*, respectively, that are formed along a direction (direction Y) that is substantially perpendicular to the direction address electrodes 21 are formed (direction X), and protrusion electrodes 12*a* and 13*a*, respectively.

Bus electrodes 12*b* and 13*b* are mounted to the outside of the ends of discharge cells 67R, 67G, and 67B, that is, outside of the regions of discharge cells 67R, 67G, and 67B. Bus electrodes 12*b* and 13*b* do, however, overlap the areas of barrier ribs 65 between discharge cells 27R, 27G, and 27B adjacent along the direction of address electrodes 21 and extend into non-discharge regions 26. Protrusion electrodes 12*a* and 13*a* are formed extended from bus electrodes 12*b* and 13*b*, respectively. For each row of discharge cells 67R, 67G, and 67B along direction Y, protrusion electrodes 12*a* overlap and protrude from corresponding bus electrode 12*b* into the areas of discharge cells 67R, 67G, and 67B, and protrusion electrodes 13*a* overlap and protrude from corresponding bus electrode 13*b* into the areas of discharge cells 67R, 67G, and 67B. Therefore, one protrusion electrode 12*a* and one protrusion electrode 13*a* are formed opposing one another in each area corresponding to each of discharge cells 67R, 67G, and 67B.

Discharge sustain electrodes 12 and 13 also include projections 12*c* and 13*c*, respectively, that integrally extend from bus electrodes 12*b* and 13*b* in the same direction as protrusion electrodes 12*a* and 13*a*. Projections 12*c* and 13*c* extend into non-discharge regions 66 between protrusion electrodes 12*a* and 13*a*, respectively, and cover portions of second barrier rib members 65*b*.

Figure 16:
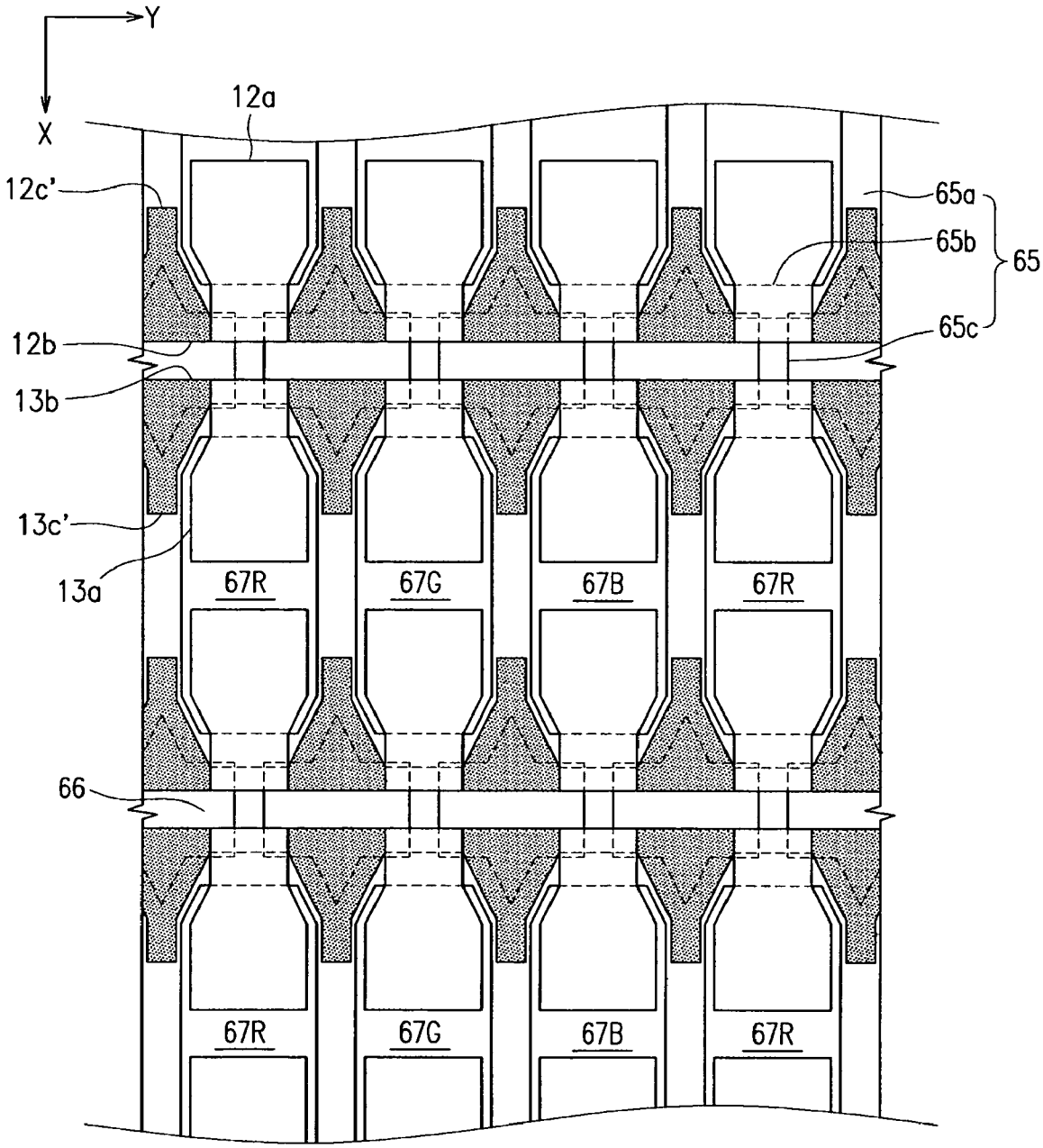
FIG. 16 is a partial plan view of a modified example of the plasma display panel embodiment of FIG. 14.

FIG. 16 is a partial plan view of a modified example of the PDP embodiment of FIG. 14. Projections 12*c*' and 13*c*' of bus electrodes 12*b* and 13*b* extend into non-discharge regions 66 and cover portions of second barrier rib members 65*b* as in the PDP of FIGS. 14 and 15, and extend also to cover a portion of first barrier rib members 65*a*.

Figure 17:
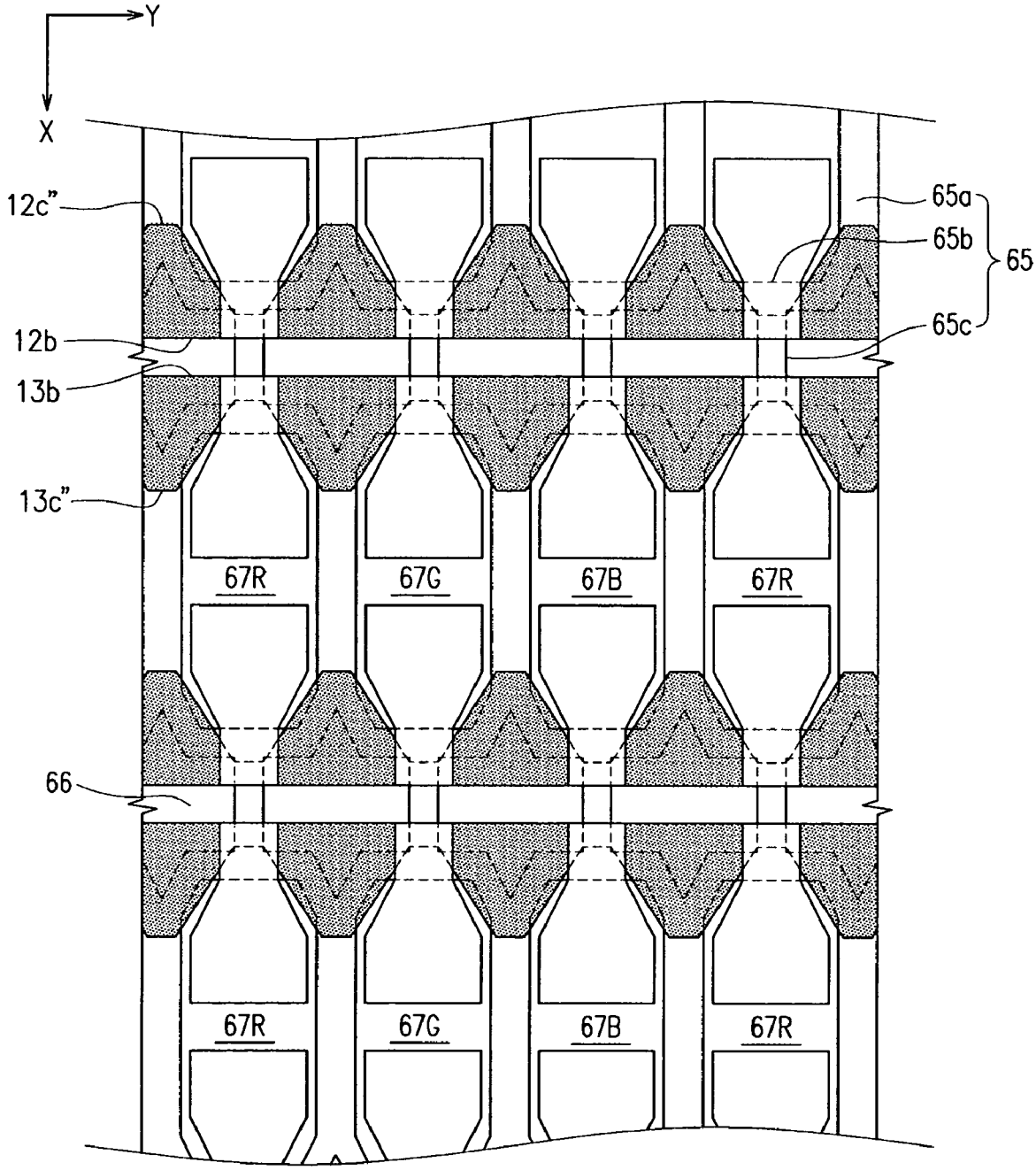
FIG. 17 is a partial plan view of another modified example of the plasma display panel embodiment of FIG. 14.

FIG. 17 is a partial plan view of another modified example of the PDP embodiment of FIG. 14. Projections 12*c*" and 13*c*" of bus electrodes 12*b* and 13*b* cover non-discharge regions 66 and all of the areas of second barrier rib members 65*b* that define non-discharge regions 66. Projections 12*c*" and 13*c*" also extend slightly into discharge cells 67R, 67G, and 67B.

Although projections 12*c*, 13*c*, 12*c*', 13*c*', 12*c*", and 13*c*" are shown in FIGS. 14 through 17 as extending into each of non-discharge regions 66, it is also for these elements to extend into select non-discharge regions 66. In the seventh embodiment and modified examples, protrusion electrodes 12*a* and 13*a* are transparent electrodes, and bus electrodes 12*b* and 13*b*, as well as projections 12*c*, 13*c*, 12*c*', 13*c*', 12*c*", and 13*c*" are made of a metal material.

With the configuration described above, external light irradiated through first substrate 10 is absorbed and blocked by projections 12*c*, 13*c*, 12*c*', 12*c*', 12*c*", and 13*c*" such that the reflexibility of the external light is reduced and contrast is enhanced.

Figure 18:
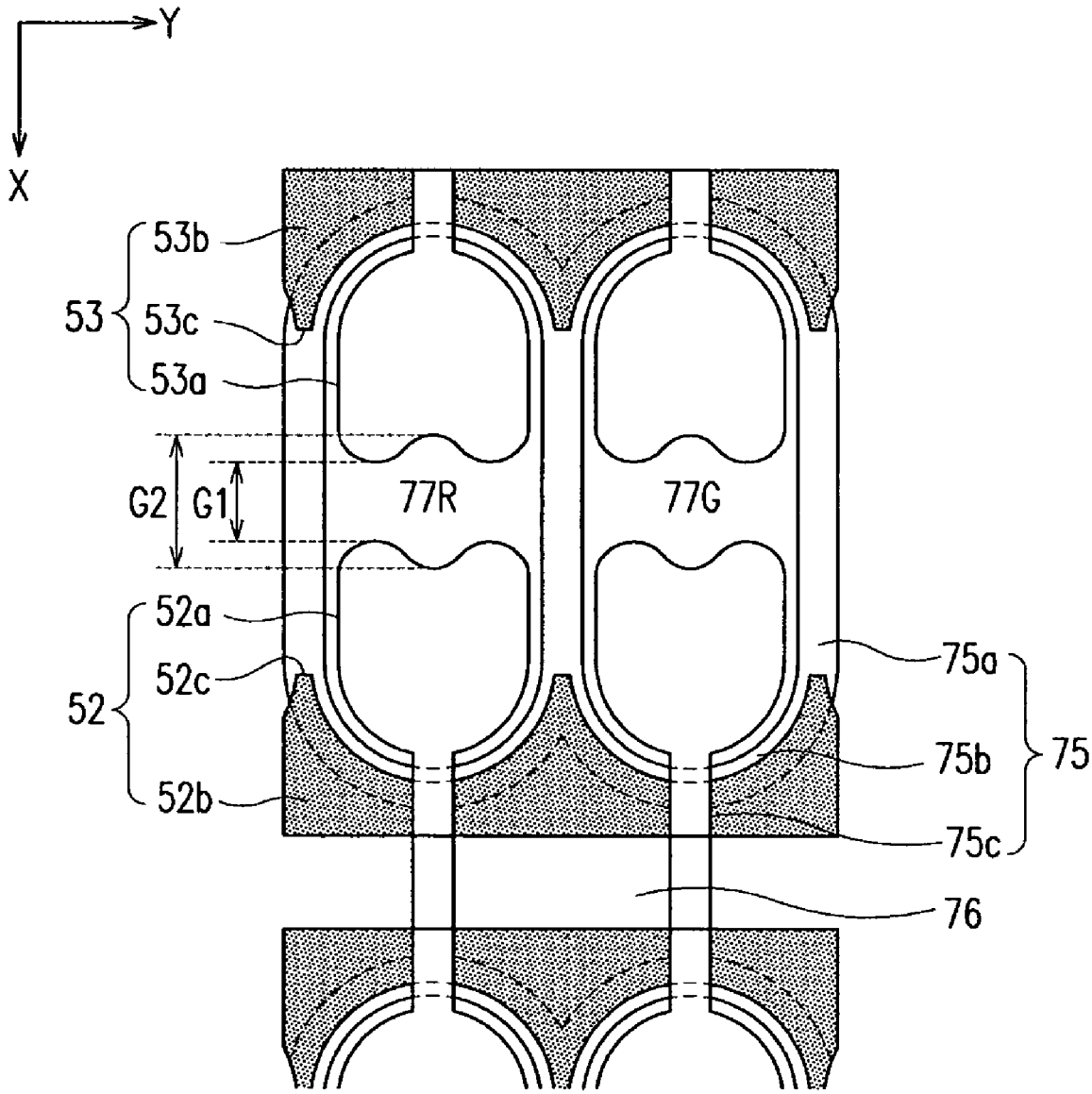
FIG. 18 is a partial plan view of a plasma display panel according to an eighth embodiment of the present invention.

FIG. 18 is a partial plan view of a PDP according to an eighth embodiment of the present invention. In the eighth embodiment, ends of discharge cells 77R and 77G (discharge cell 77B is not shown but has the same configuration) are formed reducing in width in the direction of discharge sustain electrodes 52 and 53 as a distance from a center of each of discharge cells 77R and 77G is increased. This reduction is width is realized gradually such that the ends of discharge cells 77R, 77G, and 77B are arc-shaped.

Discharge sustain electrodes 52 and 53 include respectively protrusion electrodes 52*a* and 53*a*, bus electrodes 52*b* and 53*b*, and projections 52*c* and 53*c*. Barrier ribs 75 define non-discharge regions 76 and include first barrier rib members 75*a* formed along the direction of the address, electrodes, second barrier rib members 75*b* formed along a direction that is not parallel to the direction of the address electrodes, and third barrier rib members 75*c* for interconnecting second barrier rib members 75*b* that are adjacent along the direction of the address electrodes.

Projections 52*c* and 53*c*, which are integrally extended from bus electrodes 52*b* and 53*b* in the same direction of protrusion electrodes 52*a* and 53*a*, are curved to match the arc shape of second barrier rib members 75*b*.

Protrusion electrodes 52*a* and 53*a* are formed extended from bus electrodes 12*b* and 13*b*, respectively, as described above. Distal ends of protrusion electrodes 52*a* and 53*a* are formed such that center areas along direction Y are indented and sections to both sides of the indentations are protruded. Therefore, in each of discharge cells 77R and 77G, first discharge gap G1 and second discharge gap G2 of different sizes are formed between opposing protrusion electrodes 52*a* and 53*a*. That is, second discharge gaps G2 (or long gaps) are formed where the indentations of protrusion electrodes 52*a* and 53*a* oppose one another, and first discharge gaps G1 (or short gaps) are formed where the protruded areas to both sides of the indentations of protrusion electrodes 52*a* and 53*a* oppose one another. Accordingly, plasma discharge, which initially occurs at center areas of discharge cells 77R and 77G, is more efficiently diffused such that overall discharge efficiency is increased.

Figure 19:
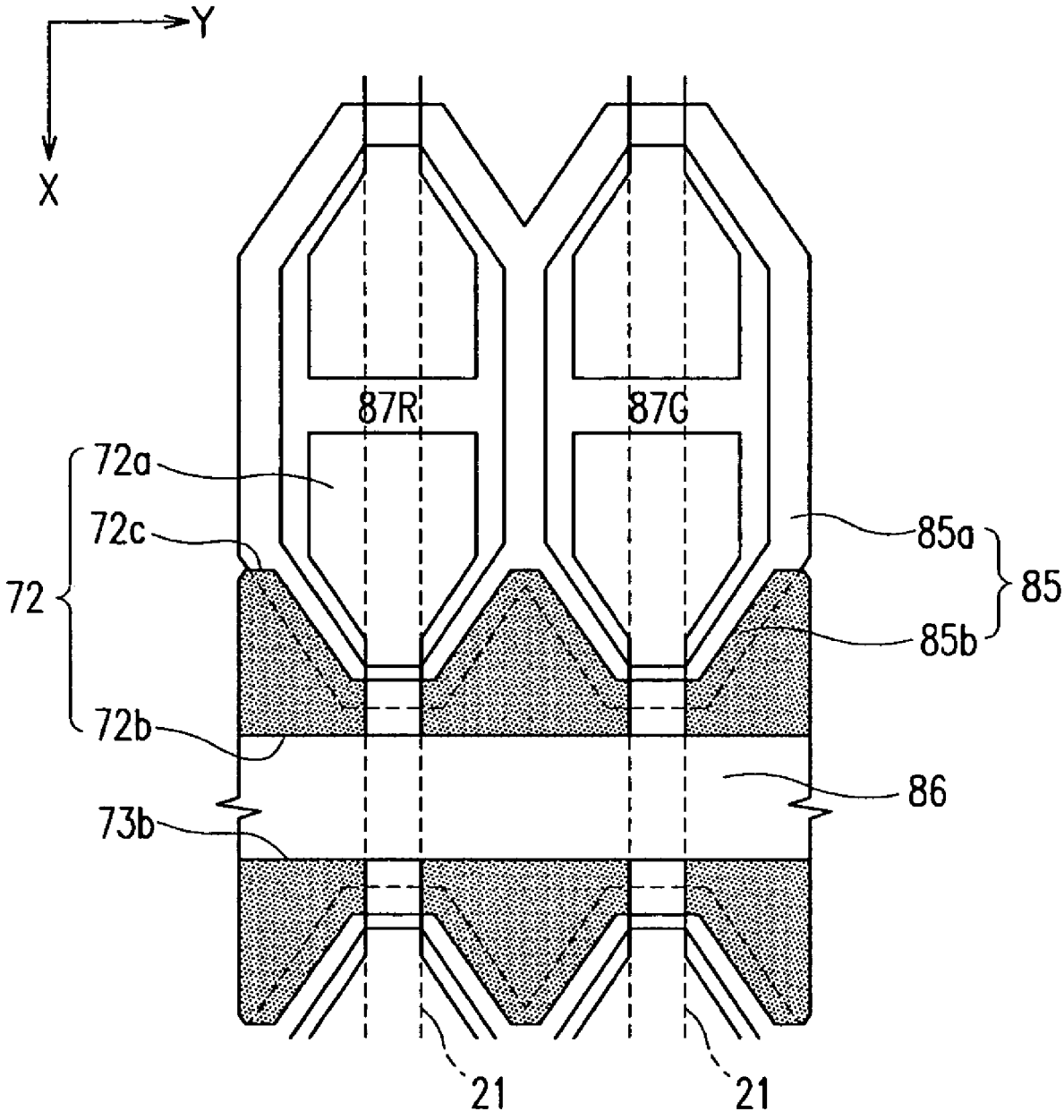
FIG. 19 is a partial plan view of a plasma display panel according to a ninth embodiment of the present invention.

FIG. 19 is a partial plan view of a PDP according to a ninth embodiment of the present invention. In the ninth embodiment, barrier ribs 85 define non-discharge regions 86 and discharge cells 87R and 87G (discharge cell 87B is not shown but has the same configuration) as in the first embodiment. Barrier ribs 85 include first barrier rib members 85*a* formed in the direction of address electrodes 21, and second barrier rib members 85*b* formed in a direction that is not parallel to the direction address electrodes 21 are formed. Non-discharge regions 86 are formed as passageways extended in a direction of discharge sustain electrodes 72 between rows of discharge cells 87R and 87G adjacent in the direction of address electrodes 21.

Discharge sustain electrodes 72 include bus electrodes 72*b* and protruding electrodes 72*a* extended from bus electrodes 72*b*. Bus electrodes 72*b*, 73*b* are formed outside the ends of the discharge cells. Discharge sustain electrodes 72 also include projections 72*c* that are extended in the same direction of protrusion electrodes 72*a* to cover portions of non-discharge regions 86 and part of second barrier rib members 85*b*.

In the PDP of the present invention described above, the formation of the discharge regions is optimized to improve the diffusion of discharge gas and thereby enhance discharge efficiency. Furthermore, the bus electrodes are mounted to the outside of the discharge cells and positioned with the non-discharge regions such that a reduction in aperture ratio caused by the formation of the bus electrodes is prevented. Brightness is improved as a result.

Although embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A plasma display panel comprising:

a first substrate and a second substrate opposing one another with a gap therebetween;

address electrodes on the second substrate;

barrier ribs between the first substrate and the second substrate, the barrier ribs comprising walls for a plurality of discharge cells and for a plurality of non-discharge regions;

a phosphor layer within each of the discharge cells; and discharge sustain electrodes on the first substrate and extending in a direction crossing the address electrodes, wherein the non-discharge regions are in areas encompassed by discharge cell abscissas through centers of adjacent said discharge cells and discharge cell ordinates through centers of adjacent said discharge cells, the discharge cell ordinates being parallel with the address electrodes, wherein ends of the discharge cells gradually decrease in width along the extending direction of the discharge sustain electrodes as a distance from a center of a corresponding one of the discharge cells is increased along an extending direction of the address electrodes, and wherein the discharge sustain electrodes include bus electrodes extending in a direction substantially perpendicular to the extending direction of the address electrodes and outside areas of the discharge cells but across areas of the non-discharge regions, and protrusion electrodes extending from each of the bus electrodes such that a pair of opposing said protrusion electrodes is in an area corresponding to one of the discharge cells.

2. The plasma display panel of claim 1, wherein the barrier ribs of adjacent said discharge cells form the non-discharge regions into cell structures.

3. The plasma display panel of claim 2, wherein the non-discharge regions are formed by the barrier ribs separating diagonally the adjacent said discharge cells.

4. The plasma display panel of claim 2, wherein each of the non-discharge regions having a cell structure is divided into a plurality of individual cells.

5. The plasma display panel of claim 1, wherein the ends of the discharge cells are in the shape of a trapezoid with base removed.

6. The plasma display panel of claim 1, wherein the ends of the discharge cells are arc-shaped.

7. The plasma display panel of claim 1, wherein a width of proximal ends of the protrusion electrodes corresponding to the location of the ends of the discharge cells decreases as a distance from a center of a corresponding one of the discharge cells is increased.

8. The plasma display panel of claim 7, wherein both sides of the proximal ends are formed uniformly with inner walls of the corresponding one of the discharge cells.

9. The plasma display panel of claim 7, wherein distal ends of the protrusion electrodes of at least one of each pair of the discharge sustain electrodes are indented to form indentations, thereby forming a first discharge gap and a second discharge gap of different sizes between the opposing said protrusion electrodes.

10. The plasma display panel of claim 9, wherein the indentations are at center areas of the distal ends of the protrusion electrodes along the direction substantially perpendicular to the extending direction of the address electrodes.

11. The plasma display panel of claim 9, wherein sections at both sides of the indentations protrude.

12. The plasma display panel of claim 1, wherein the barrier ribs comprise first barrier rib members substantially parallel to the extending direction of the address electrodes, and second barrier rib members in a direction oblique to the extending direction of the address electrodes, and wherein the second barrier rib members are at an angle to the extending direction of the address electrodes to cross over the address electrodes.

13. The plasma display panel of claim 12, wherein the first barrier rib members and the second barrier rib members are at different heights.

14. The plasma display panel of claim 13, wherein a height of the first barrier rib members is greater than a height of the second barrier rib members.

15. The plasma display panel of claim 13, wherein a height of the first barrier rib members is less than a height of the second barrier rib members.

16. The plasma display panel of claim 9, wherein the discharge cells include discharge gas containing 10% or more Xenon.

17. The plasma display panel of claim 16, wherein the discharge cells include discharge gas containing 10-60% Xenon.

18. The plasma display panel of claim 1, wherein ventilation paths are on the barrier ribs of the non-discharge regions.

19. The plasma display panel of claim 18, wherein the ventilation paths are grooves in the barrier ribs to communicate the discharge cells with the non-discharge regions.

20. The plasma display panel of claim 19, wherein the grooves have substantially an elliptical planar configuration.

21. The plasma display panel of claim 19, wherein the grooves have substantially a rectangular planar configuration.

22. The plasma display panel of claim 1, wherein the discharge sustain electrodes comprise scan electrodes and display electrodes, one said scan electrode and one said display electrode corresponding to a row of the discharge cells, the scan electrodes and the display electrodes comprising protrusion electrodes extending into the discharge cells while opposing one another, wherein a width of proximal ends of the protrusion electrodes is smaller than a width of distal ends of the protrusion electrodes, and wherein the address electrodes comprise line regions extending in the extending direction of the address electrodes, and enlarged regions expanding along a direction substantially perpendicular to the extending direction of the line regions to correspond to the shape of protrusion electrodes of the scan electrodes.

23. The plasma display panel of claim 22, wherein the enlarged regions of the address electrodes have a first width at areas opposing the distal ends of the protrusion electrodes, and a second width smaller than the first width at areas opposing the proximal ends of the protrusion electrodes.

24. The plasma display panel of claim 1, wherein the discharge sustain electrodes comprise scan electrodes and display electrodes, one said scan electrode and one said display electrode corresponding to a row of the discharge cells, wherein each of the scan electrodes and the display electrodes includes a bus electrode extending in a direction substantially perpendicular to the extending direction of the address electrodes, and protrusion electrodes extending into the discharge cells from the bus electrode such that the protrusion electrodes of the scan electrodes oppose the protrusion electrodes of the display electrodes, and wherein the bus electrode of one of the display electrodes is between adjacent said discharge cells of every other row of the discharge cells, and the bus electrodes of the scan electrodes are between the adjacent said discharge cells and between the bus electrodes of the display electrodes.

25. The plasma display panel of claim 24, wherein the protrusion electrodes of the display electrodes extend from the bus electrodes of the display electrodes into discharge cells adjacent to opposite sides of the bus electrodes.

26. The plasma display panel of claim 24, wherein the bus electrodes of the display electrodes have a width greater than a width of the bus electrodes of the scan electrodes.

27. The plasma display panel of claim 1, wherein the bus electrodes comprise projections extending from the bus electrodes in an extending direction of the protrusion electrodes.

28. The plasma display panel of claim 27, wherein the projections of the bus electrodes are between the discharge cells adjacent in the extending direction of the protrusion electrodes.

29. The plasma display panel of claim 27, wherein the projections of the bus electrodes extend over predetermined areas of the non-discharge regions and the barrier ribs.

* * * * *